US011015787B2

(12) United States Patent
Evans et al.

(10) Patent No.: US 11,015,787 B2
(45) Date of Patent: May 25, 2021

(54) LIGHTING FIXTURES AND SYSTEMS INCLUDING THEM, LIGHTING ASSEMBLY ATTACHMENT SYSTEM, AND METHODS OF INSTALLING SAME

(71) Applicant: CertainTeed Ceilings Corporation, Malvern, PA (US)

(72) Inventors: Phillip Evans, Littleton, MA (US); Dennis Michaud, Groton, CT (US); Kim Dupont-Madinier, Somerville, MA (US); Timothy Briggs, Clinton, MA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 0 days.

(21) Appl. No.: 16/375,633

(22) Filed: Apr. 4, 2019

(65) Prior Publication Data

US 2019/0309932 A1 Oct. 10, 2019

Related U.S. Application Data

(60) Provisional application No. 62/657,624, filed on Apr. 13, 2018, provisional application No. 62/654,238, filed on Apr. 6, 2018.

(51) Int. Cl.
*F21V 21/04* (2006.01)
*F21S 4/28* (2016.01)
(Continued)

(52) U.S. Cl.
CPC ..... *F21V 21/049* (2013.01); *F21S 4/28* (2016.01); *F21S 8/04* (2013.01); *F21V 7/0008* (2013.01);
(Continued)

(58) Field of Classification Search
None
See application file for complete search history.

(56) References Cited

U.S. PATENT DOCUMENTS

D104,232 S 4/1937 Arenberg
2,335,735 A * 11/1943 Campen ..... 362/125
(Continued)

FOREIGN PATENT DOCUMENTS

EM 001829953-0013 4/2011
EM 001402416-0007 7/2014
(Continued)

*Primary Examiner* — Ashok Patel
(74) *Attorney, Agent, or Firm* — McDonnell Boehnen Hulbert & Berghoff LLP

(57) ABSTRACT

The present disclosure relates generally to light fixtures and to lighting assembly attachment systems. The present disclosure provides a lighting fixture extending no more than 3 inches from the building surface. A light source is disposed in a housing thereof and is configured to emit light through the open side of the housing so as to direct the light in an upward direction. The disclosure also provides lighting assembly including a housing having a base and a cavity below the base, a light source disposed in the cavity of the housing, and one or more clips configured to attach to a flange of a ceiling support beam. Each clip includes an upper arm, a lower arm, and a retainer disposed on the lower arm configured to engage the base of the housing such that the housing is held up by the one or more clips.

18 Claims, 21 Drawing Sheets

(51) Int. Cl.

| | |
|---|---|
| ***F21V 7/00*** | (2006.01) |
| ***F21S 8/04*** | (2006.01) |
| ***F21V 29/503*** | (2015.01) |
| ***F21V 29/70*** | (2015.01) |
| ***F21Y 115/10*** | (2016.01) |
| ***F21Y 103/30*** | (2016.01) |

(52) U.S. Cl.
CPC ..... *F21V 21/042* (2013.01); *F21V 21/048* (2013.01); *F21V 29/503* (2015.01); *F21V 29/70* (2015.01); *F21Y 2103/30* (2016.08); *F21Y 2115/10* (2016.08)

(56) References Cited

U.S. PATENT DOCUMENTS

| | | | | |
|---|---|---|---|---|
| D203,060 | S | 11/1965 | Schaefer | |
| D208,099 | S | 7/1967 | Arrigoni | |
| 4,388,675 | A * | 6/1983 | Lewin | F21V 7/0008 362/151 |
| D336,967 | S | 6/1993 | Boundy | |
| D339,654 | S | 9/1993 | Chan | |
| D394,518 | S | 5/1998 | Burrow | |
| 5,848,833 | A | 12/1998 | Margulies | |
| D430,339 | S | 8/2000 | Reo | |
| D461,022 | S | 7/2002 | Eberlein | |
| 6,582,098 | B1 * | 6/2003 | Brown | F21V 11/06 362/291 |
| D500,878 | S | 1/2005 | Lewis | |
| D507,844 | S | 7/2005 | Friedman | |
| D546,493 | S | 7/2007 | Friedman | |
| D572,400 | S | 7/2008 | Benensohn | |
| D584,444 | S | 1/2009 | Lipson | |
| D585,153 | S | 1/2009 | Maxik | |
| D608,042 | S | 1/2010 | Wu | |
| D620,181 | S | 7/2010 | Sanoner | |
| D623,339 | S | 9/2010 | Schlabach | |
| D634,471 | S | 3/2011 | Hsieh | |
| D636,924 | S | 4/2011 | Cocksedge | |
| D638,976 | S | 5/2011 | Howls | |
| D649,282 | S | 11/2011 | McDonald | |
| D667,163 | S | 9/2012 | Blum | |
| D671,587 | S | 11/2012 | Li | |
| 2005/0281023 | A1 * | 12/2005 | Gould | F21V 13/04 362/217.05 |
| 2007/0211457 | A1 * | 9/2007 | Mayfield | F21S 8/026 362/223 |
| 2010/0091484 | A1 * | 4/2010 | Mayfield, III | F21V 15/01 362/223 |
| 2010/0103654 | A1 | 4/2010 | Yasuda et al. | |
| 2011/0019410 | A1 | 1/2011 | Ibanez et al. | |
| 2011/0069484 | A1 | 3/2011 | Wu et al. | |
| 2011/0222270 | A1 | 9/2011 | Porciatti | |
| 2013/0308303 | A1 | 11/2013 | Greenholt et al. | |
| 2014/0078728 | A1 * | 3/2014 | Rodgers | F21V 15/013 362/225 |
| 2014/0226316 | A1 | 8/2014 | Medendorp et al. | |
| 2015/0167902 | A1 * | 6/2015 | Rodgers | F21V 21/005 362/221 |
| 2017/0082269 | A1 * | 3/2017 | Castillo | G02B 6/0036 |
| 2018/0172898 | A1 * | 6/2018 | Blessitt | F21S 8/026 |
| 2018/0245753 | A1 * | 8/2018 | Magno | F21V 3/00 |

FOREIGN PATENT DOCUMENTS

| | | | |
|---|---|---|---|
| EP | 3339718 | A2 | 6/2018 |
| KR | 300505855.0000 | | 9/2008 |
| WO | 2007088665 | A1 | 8/2007 |
| WO | 2015/193290 | A1 | 12/2015 |

* cited by examiner

LIGHTING FIXTURES AND SYSTEMS INCLUDING THEM, LIGHTING ASSEMBLY ATTACHMENT SYSTEM, AND METHODS OF INSTALLING SAME

CROSS-REFERENCE TO RELATED APPLICATIONS

This application claims the benefit of priority of U.S. Provisional Patent Application No. 62/654,238, filed Apr. 6, 2018, and of U.S. Provisional Patent Application No. 62/657,624, filed Apr. 13, 2018, each of which is hereby incorporated herein by reference in its entirety.

BACKGROUND OF THE DISCLOSURE

1. Field of the Disclosure

The present disclosure relates generally to ceiling light fixtures and systems for attaching them, for example, suitable for use with a suspension ceiling or on a finished wall. In certain aspects, the present disclosure relates more particularly to a ceiling light fixture that extends down from a ceiling grid, and to a lighting assembly attachment system that secures the lighting assembly to a ceiling grid member.

2. Technical Background

Lighting fixtures are often attached to or incorporated into building surfaces such as ceilings and walls. The ceiling in particular provides an especially convenient location for lighting, because the height provides an advantage for spreading light across the area being illuminated. Further, the area in the vicinity of the ceiling is typically available as it is not being utilized for furniture or living space. Most ceiling lighting can be divided into two categories. The first category includes lights that are adjacent to or recessed in the ceiling and emit light down toward the area being illuminated. This type of lighting can be integrated into the architecture of the ceiling and direct light to certain areas. However, lighting structures that are integrated into the ceiling, particularly recessed lighting, often require that the ceiling grid be customized to accommodate the lighting fixtures. Further, the downward direction of the light emitted by this type of lighting can create glare if a person looks in the direction of the lighting fixture.

The second category includes lighting fixtures that hang down from the ceiling by a rod, cord, or other extension and project light up onto the ceiling. Such lighting fixtures provide light throughout the space being illuminated by spreading the light over the ceiling. Further, the upward lighting avoids the possibility of glare, because the lights do not shine directly toward people occupying the space being illuminated. However, hanging lights can disrupt the architecture of the ceiling, preventing a smooth open appearance, and can conflict with other building elements such as sprinklers, HVAC registers, fire alarms, and signage Moreover, lighting that is integrated into a ceiling structure, particularly recessed lighting, often requires that the ceiling grid be customized to accommodate the lighting fixtures. For instance, the installation of linear lights in a ceiling typically requires that an area of the grid be removed to provide space for the linear lighting fixture. Further, even if the removal of certain grid members is not necessary, the installation of the lighting may require that additional supporting structure be added to the ceiling grid to hold the lighting fixture in place. This process can be costly as it requires coordination between specialists that build ceiling grids and electricians who install the lighting fixtures.

The present inventors have recognized that lighting that spreads light effectively without hanging at a distance to the ceiling, would be advantageous and attractive to builders. The present inventors have also recognized that a simple solution for integrating lighting fixtures into a ceiling grid would be advantageous and attractive to builders.

SUMMARY OF THE DISCLOSURE

In one aspect, the present disclosure provides a lighting fixture comprising:

- an elongate housing extending in a first direction from a first end to a second end, the housing including:
  - a base configured to attach to a ceiling and define a mounting surface of the housing, and
  - a cover extending over the base so as to form a cavity in the housing and define a closed side of the housing and an open side of the housing, wherein the lighting fixture extends no more than 3 inches from the building surface; and
- a light source disposed in the housing, wherein the lighting fixture is configured to emit light through the open side of the housing so as to direct the light in an upward direction.

In another aspect, the disclosure provides a suspension ceiling lighting system comprising:

- a suspension ceiling including a plurality of support beams arranged in rows and columns to form a ceiling grid;
- a lighting fixture attached to the ceiling grid, the lighting fixture comprising:
  - an elongate housing extending in a first direction from a first end to a second end, the housing including:
    - a base configured to attach to a ceiling and define a mounting surface of the housing, and
    - a cover extending over the base so as to form a cavity in the housing and define a closed side of the housing and an open side of the housing, wherein the lighting fixture extends no more than 3 inches from the building surface; and
  - a light source disposed in the housing, wherein the lighting fixture is configured to emit light through the open side of the housing so as to direct the light in an upward direction.

In another aspect, the present disclosure provides a lighting assembly comprising:

- a housing including a base and a cavity below the base;
- a light source disposed in the cavity of the housing; and
- first and second clips configured to respectively attach to first and second flanges of a ceiling support beam, each of the first and second clips including:
  - an upper arm configured to engage an upper surface of the respective flange,
  - a lower arm connected to the upper arm by a joint and configured to extend below the respective flange under the upper arm, and
  - a retainer disposed on the lower arm and configured to engage the base of the housing such that the housing is held up by the respective retainers of the first and second clips and lateral movement of the first and second clips is inhibited.

In another aspect, the disclosure provides a lighting system comprising:

- a ceiling structure including a support beam comprising:
  - a vertical web, and opposing first and second flanges extending laterally outward from a lower end of the vertical web, each of the first and second flanges including an upper surface and a lower surface; and the lighting assembly according to the disclosure attached to the support beam, wherein the first and second clips of the lighting assembly are respectively attached to the first and second flanges of the support beam, with the upper arm of each clip engaging the upper surface of the respective flange and the lower arm of each clip engaging the lower surface of the respective flange so as to retain the lighting assembly on the support beam.

In another aspect, the disclosure provides a method of installing the lighting system of the disclosure, the method comprising:

providing a ceiling structure including a support beam comprising a vertical web and opposing first and second flanges extending laterally outward from a lower end of the vertical web;

securing a first clip to the first flange by positioning the first flange between an upper arm and a lower arm of the first clip, wherein the first clip includes a first retainer disposed on the lower arm;

securing a second clip to the second flange by positioning the second flange between an upper arm and a lower arm of the second clip, wherein the second clip includes a second retainer disposed on the lower arm; and attaching a housing to the first and second clips using the first and second retainers.

In another aspect, the disclosure provides a lighting system comprising:

a ceiling structure including a support beam comprising:

a vertical web, and opposing first and second flanges extending laterally outward from a lower end of the vertical web, each of the first and second flanges including an upper surface and a lower surface; and a lighting assembly comprising:

a housing including an upper surface and forming a cavity below the upper surface;

a light source disposed in the cavity of the housing; and a clip including:

an upper arm engaging an upper surface of the first flange, a lower arm connected to the upper arm by a joint and engaging a lower surface of the first flange such that the clip is attached to the first flange, and a retainer disposed on the lower arm, the retainer engaging the upper surface of the housing such that the housing is held up by the retainer.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional ceiling lights risk glare or disrupt the architecture of the ceiling. The present inventors have developed a lighting fixture for a ceiling that is attractive and effectively provides light in an area to be illuminated.

Figure 1:
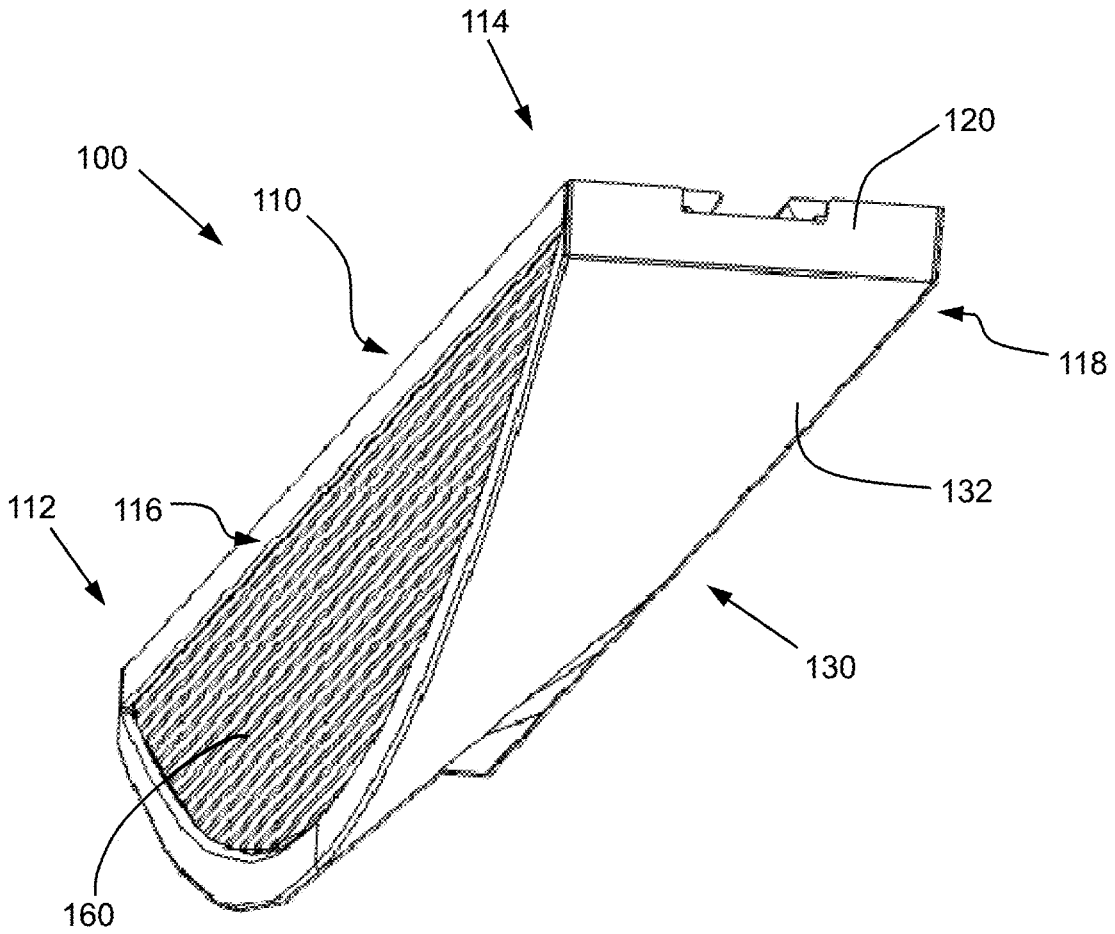
FIG. 1 is a schematic perspective view of a lighting fixture according to an embodiment of the disclosure.
Figure 2:
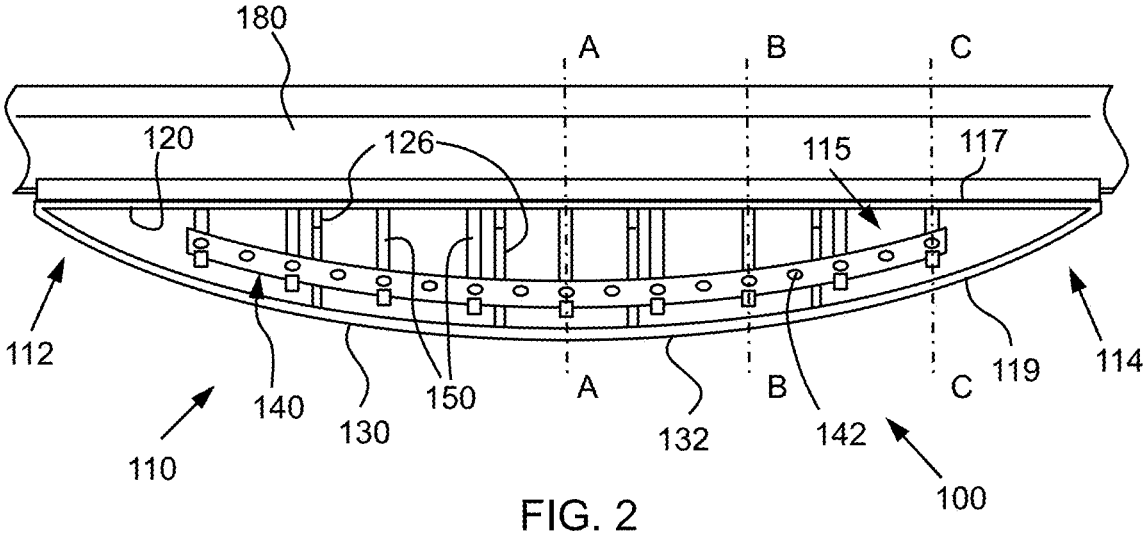
FIG. 2 is a schematic front view of the lighting fixture of FIG. 1 with the window removed.
Figure 4:
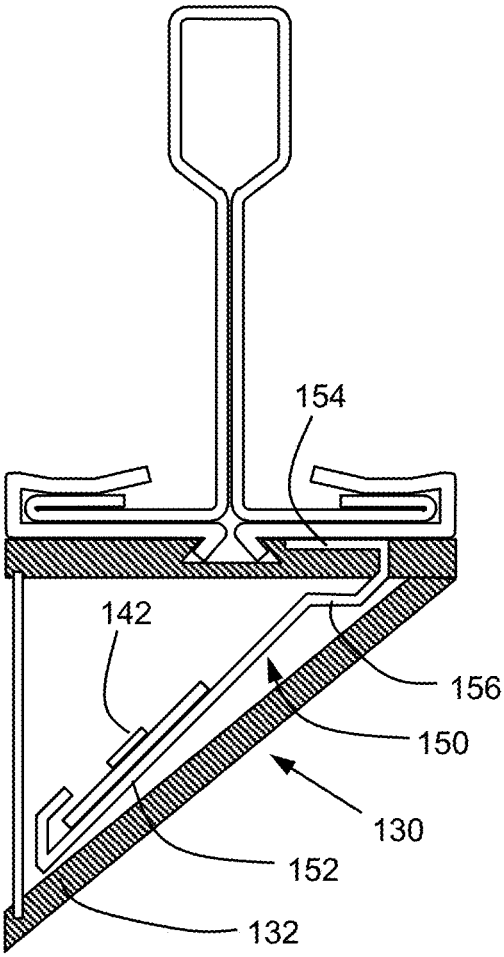
FIG. 4 is another schematic cross section of the lighting fixture of FIG. 1 taken along line B-B in FIG. 2.
Figure 5:
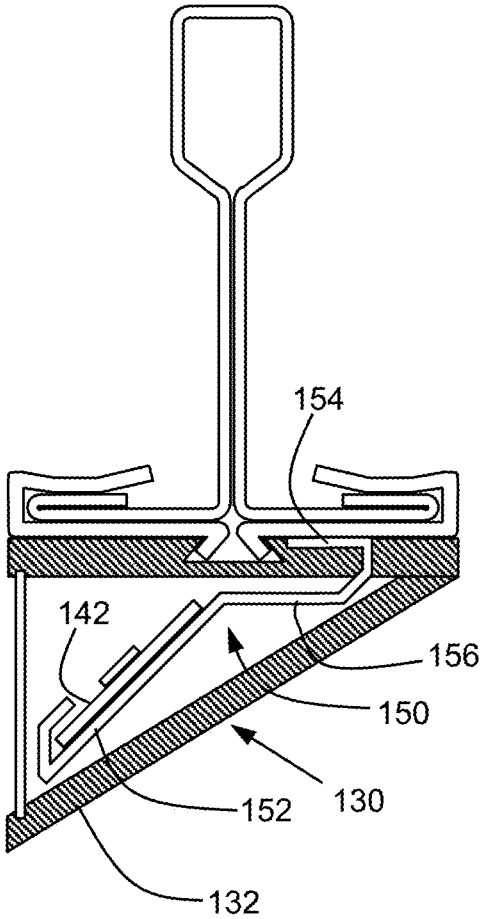
FIG. 5 is another schematic cross section of the lighting fixture of FIG. 1 taken along line C-C in FIG. 2.
Figure 3:
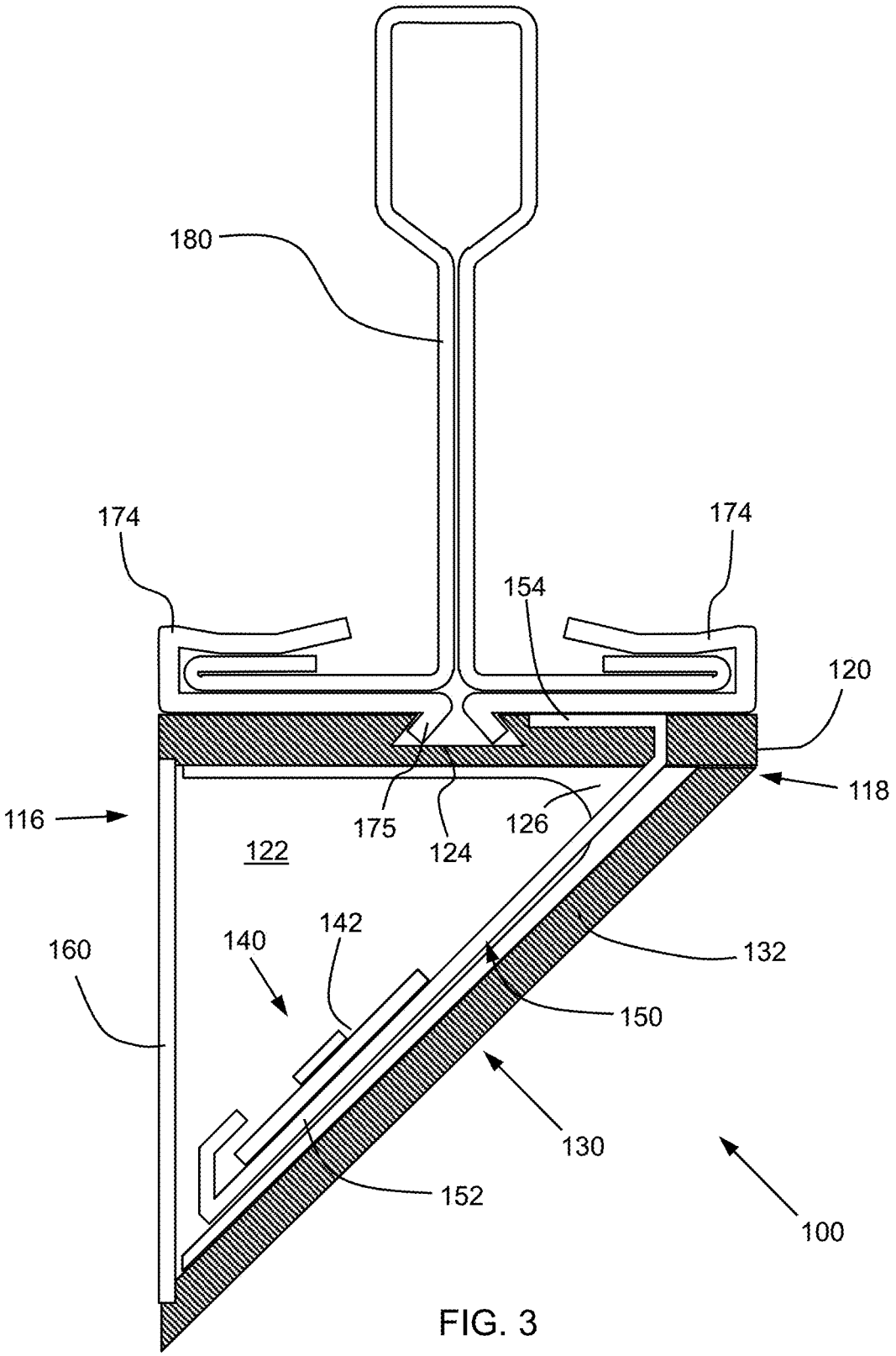
FIG. 3 is a schematic cross section of the lighting fixture of FIG. 1 taken along lines A-A in FIG. 2.

Accordingly, one aspect of the disclosure is a lighting fixture including an elongate housing extending in a first direction from a first end to a second end. The housing includes a base configured to attach to a building structure and define a mounting surface of the housing and a cover extending over the base so as to form a cavity in the housing and define a closed side of the housing and an open side of the housing. The light fixture extends no more than 3 inches from the building surface. A light source is disposed in the housing and is configured to emit light through the open side of the housing so as to direct the light in an upward direction. Such a lighting fixture is schematically shown in FIGS. 1-5. FIG. 1 shows a schematic perspective view of the lighting fixture from the right, front and bottom. Lighting device 100 includes an elongate housing 110 that extends from a first end 112 to a second end 114. Housing 110 is formed by a base 120 and a cover 130 that extends over base 120 forming a cavity within the housing. Housing 110 includes an open side 116 and a closed side 118. A window 160 is provided at the open side 116 and encloses the housing 110, as described in further detail below. FIG. 2 is a schematic front view of lighting fixture 100 attached to a support beam 180 of a ceiling grid with window 160 removed. FIGS. 3, 4 and 5 show schematic lateral cross sections A, B and C of lighting fixture 100 attached to support beam 180 at points between first end 112 and second end 114, as described in further detail below. The term lateral cross section, as used herein, refers to a cross section that is perpendicular to the elongate direction of the lighting fixture.

The light source is configured to emit light through the open side of the housing so as to direct the light in an upward direction. Base 120 of housing 110 is configured to attach to a building surface and accordingly defines the mounting surface of the housing. In particular, base 120 is configured to attach to a ceiling surface. To secure base 120 to the ceiling surface, the base is attached by two clips 174 to a support beam 180 of a ceiling grid (see FIG. 3), as described in more detail below. Cover 130 extends over base 120 so as to form a cavity 122 in the housing 110. The cover 130 and base 120 are adjacent on the closed side 118 of housing 110 so that light from the fixture is directed out of the open side 116. Because light fixture 100 is configured for attachment to a ceiling, the mounting surface of the housing is on the upper side of lighting fixture 100.

Lighting fixture 100 further includes a light source 140 disposed in the cavity 122 of housing 110. The components of the lighting fixture 100 are configured so that the light emitted from lighting fixture 100 is directed in an upward direction. The term "upward direction," as used herein, includes any direction with an upward component. In other words, any direction with an angle above the horizontal is one that is directed in an "upward direction." In certain embodiments, the center of a light beam emitted from the light source is directed in the upward direction. In some embodiments, substantially all of the light emitted from the light source is directed in an upward direction. The phrase "substantially all of the light," as used herein, means at least 75% of the light (measured by a power meter) emitted from the fixture.

The light source may take a variety of different forms, as will be appreciated by those of ordinary skill in the art. For example, the depicted embodiments include a light source in the form of a light emitting diode (LED) element (e.g., an organic light-emitting diode), as described in more detail below. Other light sources include lamps, such as incandescent, fluorescent or halogen bulbs. The light source may also be a laser light source or another light source.

In certain embodiments as otherwise described herein, the cover includes an elongate wall extending from the base at the closed side of the housing to the open side of the housing. At least a portion of the elongate wall is disposed at an angle to the base so as to form the cavity of the housing between the base and the angled wall. For example, cover 130 of housing 110 is formed by elongate wall 132 that extends over base 120. At the closed side 118 of housing 110 elongate wall 132 is adjacent to base 120, but the central portion of elongate wall 132 extends away from base 120 at an acute angle toward open side 116, as seen, for example, in FIG. 3. The angle between base 120 and elongate wall 132 provides a cavity within housing 110 between the base and the elongate wall. In some embodiments, the angle between the base and the elongate wall is defined by an upper surface of the base that runs parallel to the ceiling and the outer, exposed surface of the elongate wall.

Figure 6:
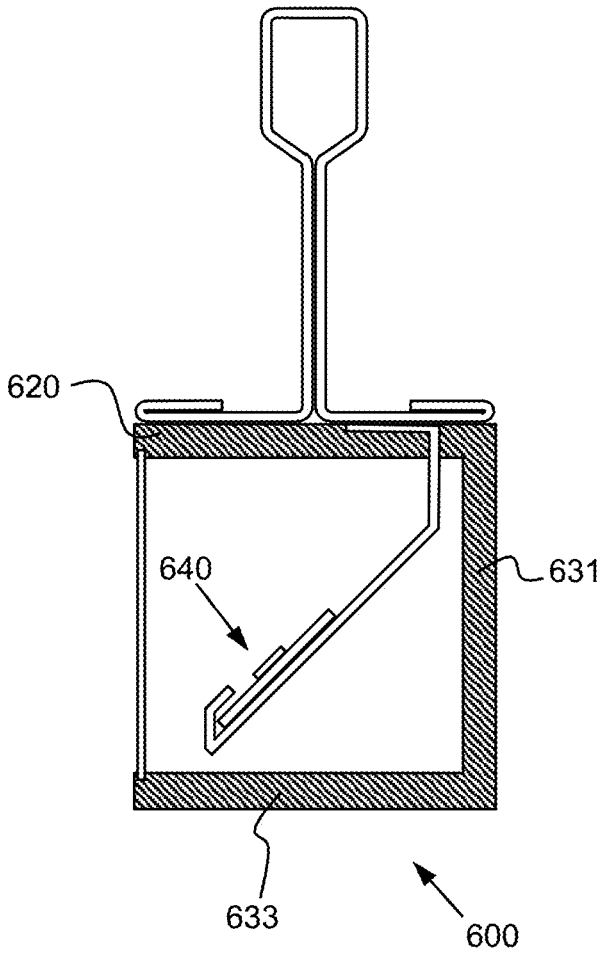
FIG. 6 is a schematic cross section of a light fixture according to another embodiment of the disclosure.

In other embodiments, the cover includes a plurality of walls that cooperate to form a cavity within the housing. For example, in lighting fixture 600, shown in FIG. 6, cover 630 has a polygonal cross section without any wall extending at an acute angle from the base 620. In particular, cover 630 includes a side wall 631, a lower wall 633 and two end walls that form the cavity 622 that houses light source 640.

In certain embodiments as otherwise described herein, the elongate wall is adjacent and parallel to the base at the first end and at the second end, such that the housing is closed at the first end and the second end. For example, as seen in FIGS. 1 and 2, elongate wall 132 bends upward at the outer ends 112, 114 of the lighting fixture housing 110 such that the ends of elongate wall 132 are adjacent to base 120 and parallel thereto. As a result, housing 110 is closed at both ends 112, 114 by the curvature of elongate wall 132. In other embodiments, the elongate wall of the cover of the housing is planar, such that the elongate wall is disposed at an acute angle to the base across the entire length of the lighting fixture. Such a housing may be enclosed at the ends by end walls that extend between the base and the elongate wall.

In certain embodiments as otherwise described herein, the housing is formed as a single piece, where the base and the cover are integrally formed at the closed side of the housing. In other embodiments, the cover and base are formed separately and attached, for example using mechanical fasteners. In some embodiments a light shield is at least partially surrounding the mechanical fastener to prevent light from escaping the housing through any openings associated with the fastener.

Figure 1A:
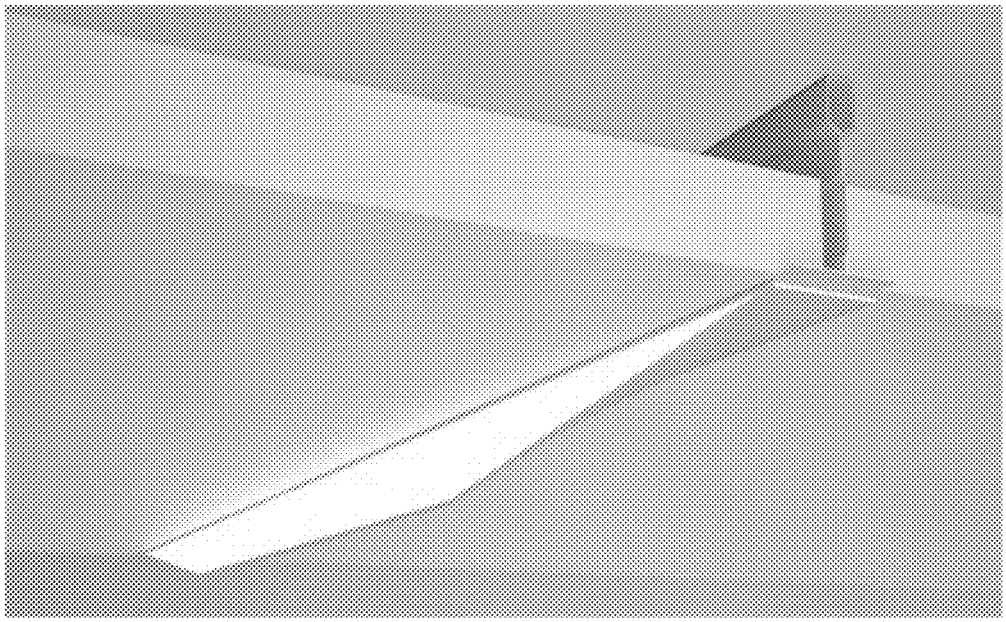
FIG. 1A is a schematic perspective view of a lighting fixture according to another embodiment of the disclosure.

In certain embodiments as otherwise described herein, the open side of the housing includes an opening having a straight edge defined by the base and a curved or angular edge defined by the cover. For example, as shown in FIG. 2, the housing 110 of lighting fixture 100 includes an opening 115 on the open side thereof. The edges of opening 115 are defined by the base 120 and the elongate wall 132 of cover 130. In particular, the top of opening 115 is bounded by a straight edge 117 formed by base 120 and the bottom of opening 115 is bounded by a curved edge formed by elongate wall 132. The curved edge 119 of opening 115 allows the lighting fixture to gradually extend downward from the ceiling along its length so as to minimize visual disruption of the ceiling surface. Similarly, as shown in FIG. 1A, the edge defined by the cover can be angular. The embodiment of FIG. 1A shows the edge defined by the cover having three linear segments, with the middle portion along the length of the cover extending down from the base by more distance than the edge portions along the length of the cover. Of course, in other embodiments, the cover forms a substantially rectangular cavity; a variety of other shapes are possible. The person of ordinary skill in the art will appreciate that the embodiments described herein with respect to curved edges can also be embodied in devices with angular edges.

In certain embodiments as otherwise described herein, the elongate wall has the form of a ruled surface, and the angle between the cover and the base changes along at least a portion of the length of the housing. In other words, at each lateral cross section along the length of the lighting fixture, the outer surface of the cover is substantially straight. For example, elongate wall 132 has the form of a ruled surface. At each lateral cross section of the housing 110, the outer surface of elongate wall 132 is straight and disposed at angle to base 120. In particular, at each end of housing 110, elongate wall 132 is parallel to base 120. Toward the center of housing 110, the angle between elongate wall 132 and base 120 increases to a peak angle between the two ends 112, 114. FIGS. 3, 4 and 5 show various lateral cross sections of housing 110 with elongate wall 132 disposed at varying angles. In particular at lateral cross section A, shown in FIG. 3, which is the midpoint between ends 112 and 114, the angle between base 120 and elongate wall 132 is at its peak. Lateral cross section B is closer to housing end 114, and thus the angle between elongate wall 132 and base 120 at this cross section is somewhat shallower. At lateral cross section C, which is still closer to end 114, the angle between elongate wall 132 and base 120 is even shallower. While the ruled surface of elongate wall 132 forms a simple curve along the lower edge 119 with only one smooth peak, in other embodiments, the ruled surface forms an undulating path along the curved edge of the housing opening.

In certain embodiments as otherwise described herein, an edge surrounding the opening is planar. For example, in lighting housing 110, the straight upper edge provided by base 120 and the curved lower edge provided by cover 130 form the outer edge of opening 115. As shown in FIGS. 3-5, the edge at the open side 116 of housing 110 is planar. In order to achieve the planar edge of opening 115, the size of elongate wall 132 changes over the length of the housing and is larger in middle of lighting fixture 110, with respect to the lateral cross section, than it is at the ends 112, 114.

In certain embodiments as otherwise described herein, a width of the lighting fixture is no more than 6 inches, e.g., no more than 2 inches. In certain embodiments, the width of the lighting fixture is in a range from ½ inch to 1-½ inches, e.g. between ¾ inch and 1¼ inch, or between ¾ inch and 2 inches, or between 1 inch and 2 inches, or between 1-¼ inch and 2 inches. Within this range, as explained in more detail below, the width of the lighting fixture can approximate the width of a corresponding support beam of the ceiling grid. Accordingly, the lighting fixture can blend in with the ceiling, and even go unnoticed when the light source is not illuminated.

In certain embodiments as otherwise described herein, a length of the lighting fixture is in a range from 18 to 55 inches, e.g., about 24 inches or e.g., about 48 inches. For example, in some embodiments, the length of the lighting fixture corresponds to the length of a neighboring ceiling tile within a suspension ceiling in which the lighting fixture is installed. The coordination of the lighting fixture length and ceiling tile length allows for beneficial lighting designs, as described in more detail below. As described in more detail below, the lighting fixtures described herein can be configured in a number of ways with respect to a ceiling support grid, e.g., along the grid members in linear or non-linear arrangements, crossing from one grid member to another, and at non-orthogonal angles relative to the ceiling support grid.

In certain embodiments as otherwise described herein, a height of the lighting fixture is less than 3 inches, e.g., less than 2 inches. At the distance of many ceilings, this height can be inconspicuous when the light source is not illuminated, but provide a bright contrast from the surrounding ceiling structure when the light source within the light housing is illuminated.

In certain embodiments as otherwise described herein, the housing is plastic. For example, housing 110 of lighting fixture 100 is formed from polycarbonate. In other embodiments, the housing is formed of other plastic materials. Still in other embodiments, the housing is formed of other materials, such as metals. For example, in some embodiments the housing is formed of aluminum.

In certain embodiments as otherwise described herein, the base of the housing includes a fastener configured to removably secure the lighting fixture to a ceiling (e.g., through a ceiling grid member) or other building structure. A wide variety of fasteners can be used, e.g., magnets, glues, tapes, clips, screws or brads. However, in certain desirable embodiments, clips are used to fasten to base of the housing to a ceiling or other building structure.

In one example, shown in FIG. 3, the base 120 of housing 110 in lighting fixture 100 includes a retainer 124 that engages with two clips 174. Clips 174 are attached to opposing flanges of a support beam 180 of the ceiling grid. When retainer 124 engages with clips 174, the clips act to hold housing 110 up against the ceiling, while the retainer 124 acts to prevent lateral movement of the clips off the flanges of support beam 180.

In certain embodiments as otherwise described herein, the fastener is a dovetail recess. For example, retainer 124 of base 120 is a dovetail recess. The recess runs along the entire length of housing 110, allowing the lighting fixture 100 to be slid over the corresponding structure of clips 174 after the clips have been placed on the support beam. Furthermore, the centrally located recess allows the base 120 of housing 110 to simultaneously engage corresponding structure of each of the clips 174, where both clips include a hook portion 175 that seize opposite sides of the dovetail recess, as shown in FIGS. 3-5. In other embodiments, the retainer may be formed as a variety of different elements. For example, in some embodiments, the retainer is a slot similar to the dovetail recess of retainer 124, with a round or rectangular cross section. In other embodiments the retainer is formed as a hook or other protrusion that engages a corresponding structure of the ceiling grid or clips attached to the ceiling grid. Still in other embodiments, the retainer is a portion of a recloseable fastener, such as hook and loop or another recloseable structure.

In certain embodiments as otherwise described herein, the base of the lighting fixture housing is part of a ceiling grid member. For example, in some embodiments the upper portion of the housing of the lighting fixture is formed by the lower section of a ceiling grid beam. In such an embodiment, the cover may be fastened to the base or integrally formed therewith.

In certain embodiments as otherwise described herein, the housing includes stiffening ribs extending between the base and the cover. For example, as shown in FIGS. 2 and 3, housing 110 includes stiffening ribs 126 disposed in the housing cavity 122 and extend between base 120 and cover 130. The stiffening ribs 126 allow cover 130 to be formed as a thin wall without being subject to breaking or undesired bending.

In certain embodiments as otherwise described herein, the light source includes an LED element comprising a plurality of LEDs. For example, light source 140 in lighting fixture 100 includes an LED strip 142 having a row of LEDs attached to a flexible circuit board. In other embodiments, the LED element includes an array of LEDs on a panel or other structure. The term LED as used herein includes conventional LEDs, organic light emitting diodes and quantum dot LEDs.

In certain embodiments as otherwise described herein, the cover includes an elongate wall and the LED element is adjacent to the elongate wall. Further, the LED element is positioned to emit light away from the cover. For example, housing 110 of lighting fixture 100 includes elongate wall 132 that forms the cover. The LED element 142 disposed in the housing positioned adjacent to elongate wall 132 and is oriented to emit light away from the elongate wall and directly toward the open side 116 of the housing.

Figure 7:
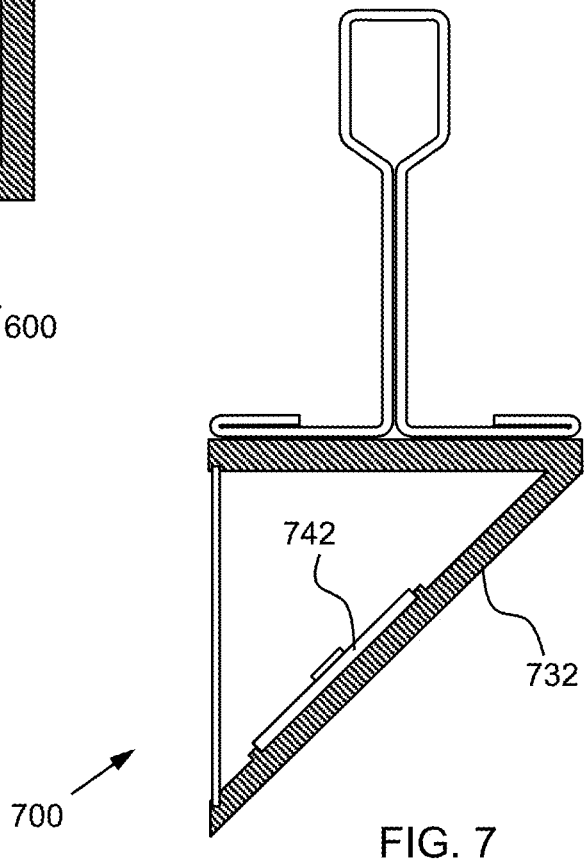
FIG. 7 is a schematic cross section of a light fixture according to another embodiment of the disclosure.

In certain embodiments, the LED element is mounted directly onto the elongate wall. For example, in lighting fixture 700, shown in FIG. 7, LED element 742 is mounted directly onto the inside surface of elongate wall 732. As a result, the LED element 742 is affixed to and parallel with the inside surface of the elongate wall 732. In other embodiments, the LED element is mounted on a support structure disposed within the housing cavity. In some embodiments using a supporting element, at least a portion of the LED element is parallel to the cover. For example, in certain embodiments as otherwise described herein a portion of the LED element is parallel to the elongate wall at a respective lateral cross section of the lighting fixture. For example, in lighting fixture 100, the LED element 142 is parallel to elongate wall 132 at the center cross section A-A, as shown in FIG. 3. In contrast, LED element 142 is at an angle to the corresponding section of elongate wall 132 at the other cross section B-B and C-C. With the LED element disposed parallel to the elongate wall, and the elongate wall at an acute angle to the base, the center of the light beam emitted from the LED element is upward. Further, the amount of light that is emitted in an upward direction is based on the angle of the LED element and the beam angle, i.e., the angle of the spread of light emitted from the LED element. These two factors can cooperate to form an LED element that directs substantially all of the light emitted therefrom in an upward direction.

Figure 8:
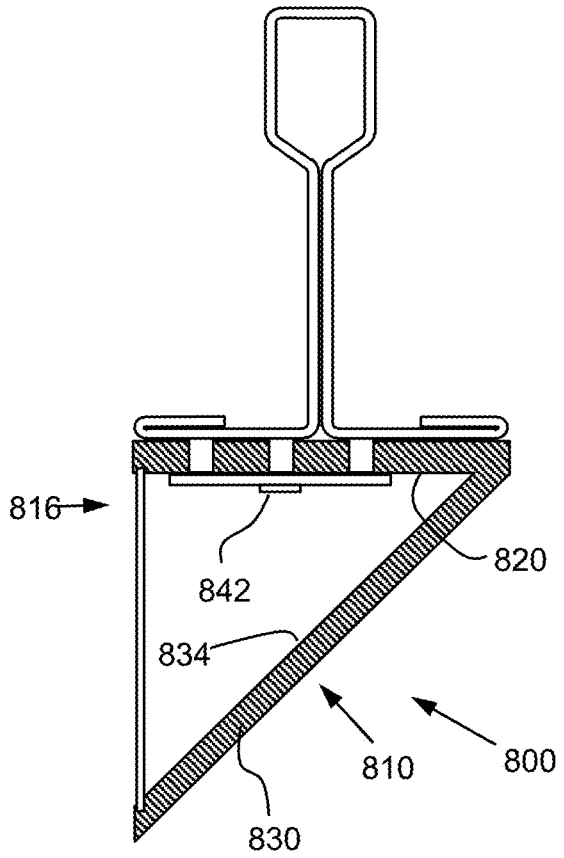
FIG. 8 is a schematic cross section of a light fixture according to yet another embodiment of the disclosure.
Figure 9:
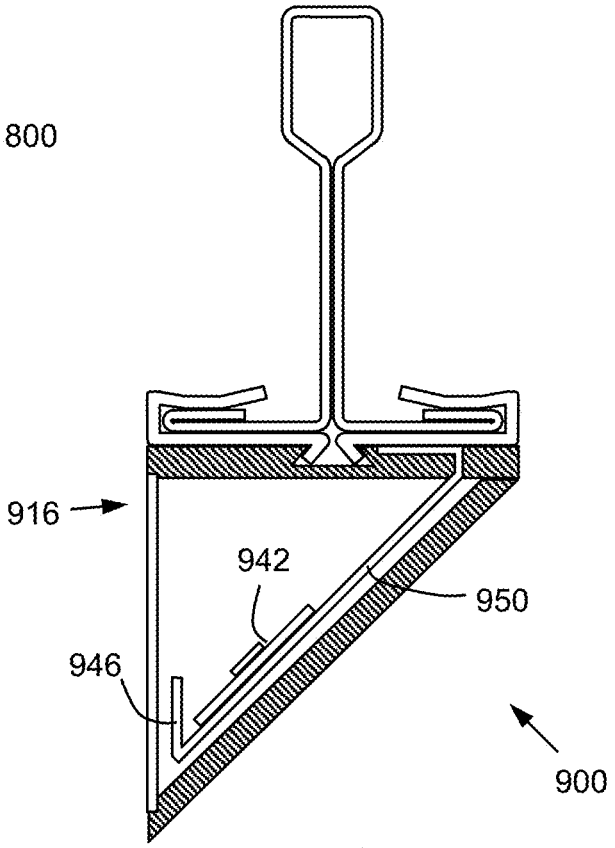
FIG. 9 is a schematic cross section of still another embodiment of the disclosure.

In certain embodiments as otherwise described herein, the LED element is adjacent to the base and is positioned to emit light away from the base. For example, lighting fixture 800, shown in FIG. 8, includes an LED element 842 that is attached to the lower surface of base 820. Accordingly, the LED element shines light downward and away from base 820 toward cover 830.

In certain embodiments as otherwise described herein, the housing includes a reflector. The reflector is operable to redirect the light emitted by the LED element. Thus, while the LED element emits light in the downward direction, the reflector redirects a majority of the light to an upward direction. In some embodiments, to avoid emitting light out of the open side of the housing, the LED element includes a narrow beam angle, so that the light emitted from the LED element is narrow and the entire beam is reflected by the reflector.

In certain embodiments as otherwise described herein, the cover forms the reflector. For example, in lighting fixture 800, elongate wall 832 of the cover has a reflective inner surface to act as a reflector 834. The reflector 834 redirects downward light from LED element 842 upward and out of the open side 816 of housing 810. In other embodiments, the reflector is a component that is separate from the base or the cover and is disposed within the cavity of the housing.

In certain embodiments as otherwise described herein, the lighting fixture further includes a light shield disposed in the housing at the lower side of the housing adjacent to the open side of the housing so as to prevent glare to observers below the lighting fixture. In certain embodiments, the light shield is part of a support structure that holds the LED element within the housing. For example, in lighting fixture 900, support element 950 includes a light shield 946 at the end thereof near the open side 916 of the housing. In other embodiments, the light shield extends from the cover of the housing. Still in other embodiments, the light shield is part of a window covering the opening of the housing. In certain embodiments the light shield is opaque so as to prevent any light from shining in the direction blocked by the light shield. In other embodiments, the light shield is semi-transparent so that light appears to shine in the areas of the light shield, but harsh lighting is prevented from passing through the light shield to the eyes of an observer.

In certain embodiments as otherwise described herein, the lighting fixture further includes a thermal conductor extending from the LED element to the mounting surface of the base. In some embodiments, the thermal conductor includes a heat pipe including a chamber containing a heat transfer fluid. For example, lighting fixture 800 includes a plurality of heat pipes 890 extending through base 820 of housing 810. Each of the heat pipes is coupled to LED element 842 on its lower side and to ceiling support beam 880 on its upper side. The heat pipes include a chamber with fluid therein that absorbs heat produced by the LED element on the lower side of the heat pump and turns to vapor, and transfers the heat to the ceiling support beam on the upper side through condensation. In other embodiments the thermal conductor has a simpler configuration, such as a metal bar or strip that passes through the base of the housing. Other configurations of the thermal conductor are also possible, as will be appreciated by those of ordinary skill in the art.

Figure 10:
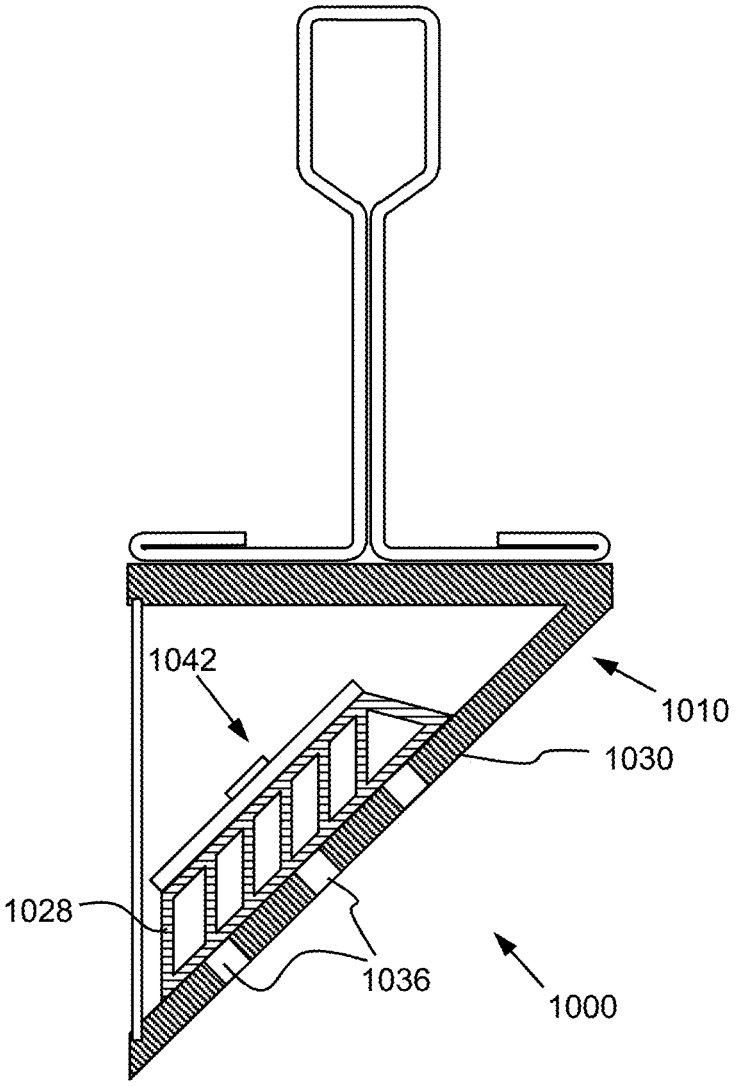
FIG. 10 is a schematic cross section of another embodiment of the disclosure.

In certain embodiments as otherwise described herein, the lighting fixture further includes a heat sink in thermal communication with the LED element. For example, lighting fixture 1000, shown in FIG. 10 includes a heat sink 1028 disposed in the housing 1010 and attached to LED element 1042. Heat sink 1028 is thermally conductive and includes a plurality of fins. The LED element 1042 is attached directly to heat sink 1028 so that heat produced by the LED element is dissipated through the large surface area of the heat sink. In some embodiments, the fins are straight fins. In other embodiments, the fins are pin fins. Various fin arrangements are possible, as will be appreciated by those of ordinary skill in the art. In certain embodiments the heat sink extends through the base of the housing in order to provide thermal communication between the heat sink and a component of the adjacent building surface, such as a ceiling grid.

In certain embodiments as otherwise described herein, the heat sink is adjacent to a section of the cover, and the section of the cover includes vents between the cavity and the external surface of the housing. For example, cover 1030 of housing 1010 has a section including a plurality of vents 1036. The vents 1036 are immediately adjacent to heat sink 1028 in order to promote fluid flow around the heat sink and increase heat dissipation from the heat sink surface.

In certain embodiments as otherwise described herein, the lighting fixture further includes a plurality of support clips. Each of the support clips includes a support leg disposed in the cavity of the housing and extending from a base leg adjacent to the base of the housing. The LED element is attached to the support legs of the support clips. For example, lighting fixture 100 includes a plurality of support clips 150 that support LED element 142 within housing 110, as can be seen in FIGS. 2-5. Each of the support clips includes a support leg 152 that extends into cavity 122 of the housing and holds the LED element 142. Further the support legs 152 are attached to a base leg 154 that is adjacent to the base 120 of the housing 110. In particular, the support clip 150 extends through base 120 such that the base leg 154 is disposed on the upper mounting surface of the housing. In some embodiments, each of the support clips includes a separate base leg. In other embodiments, the support legs of the support clips all attach to a common base leg that runs along the length of the lighting fixture.

In certain embodiments as otherwise described herein, the support clips are formed of metal. For example, in some embodiments, the support clips are aluminum. Using a metal for the support clips allows the clips to act as a thermal conductor that dissipates heat generated by the LED element, as described in more detail below. In other embodiments the support clips are formed of another material, such as plastic, and are configured to position the LED element within the housing. In some embodiments, the plastic support clips are formed of a thermally conductive plastic. In other embodiments, heat is dissipated from the LED element by another means and the material of the support clips is not specifically selected for heat dissipation.

In some embodiments the support legs of the support clips are interconnected by material. For example, in some embodiments, a band of material extends across the lower ends of the support legs in order to stiffen the support legs. In other embodiments, material fills the gap between the support clips. In other embodiments, the distal ends of the support legs are free and independent.

The use of support clips to hold the LED element allows the orientation of the LED element to be independent of the angle or shape of the cover of the housing. For example, in some embodiments, while the angle of the cover changes over a portion of the length of lighting fixture, the angle of the LED element can be kept constant over that same portion. This allows the LED element to be angled such that the direction of the light emitted therefrom is tuned to provide the desired lighting effect of the space being illuminated. Thus, in some embodiments, the support clips are disposed at a steeper angle than the cover, so that light more light is emitted horizontally. In other embodiments, the support clips are disposed at a shallower angle than the cover, so that more light is directed upward.

In some embodiments, the angle of the LED element and the beam angle of the LEDs are used in cooperate to control the direction of light emitted from the lighting element. For example, based on the angular spread of light from the LEDs, defined by the beam angle, the LED element can be angled so as to provide the light in the desired direction. For instance, in some embodiments where downward light is sought to be avoided to address glare, a larger beam angle can be compensated for by a shallower angle of the support leg so that the LED element shines more light upward. To similarly avoid light in the downward direction, a steeper angle of the support leg may be used with a narrow beam angle.

In certain embodiments as otherwise described herein, at a first lateral cross section of the lighting fixture, the support leg is parallel to the cover and at a second lateral cross section of the lighting fixture, the support leg is at an angle to the cover. For example, in lighting fixture 100, at the lateral cross section at the midpoint along the length of the housing, labelled A-A in FIG. 2 and shown in FIG. 3, the support leg 152 is parallel to elongate wall 132 of cover 130. Accordingly, LED element 142 is also parallel to the elongate wall 132. As shown in FIGS. 4 and 5 at cross sections B-B and C-C, further toward the ends 112, 114 of the housing, the elongate wall 132 has a shallower angle while support leg 152 maintains the same angle as at the midpoint of the housing.

In certain embodiments as otherwise described herein, the support leg of some of the support clips include an offset portion extending toward the open side of the housing and an angled portion supporting the LED element. In some embodiments, the offsets are straight and the angle between the offset and the base leg is shallower than the angle between the support leg and the base leg. For example, the support clips of lighting fixture 100 located at cross sections B-B and C-C each include an offset 156 that connects base leg 154 to support leg 152. The offset 156 is disposed at a different angle than support leg 152, and thereby allows support leg 152 to be positioned at a desired location within housing 110 without impacting the angle of support leg 152. In particular, the offsets 156 of the support clips in lighting fixture 100 are parallel to base leg 154 and move support leg 152 further toward the open side of the housing.

In certain embodiments as otherwise described herein, the respective offset portions of at least two of the support legs have different lengths. For example, the offset 156 in FIG. 5 near the end of housing 110 is longer than the offset 156 in FIG. 4. The longer offset toward the end of the lighting housing is able to accommodate the shallower angle of cover 130 by positioning the support leg so that the LED element is higher within the housing without impacting the angle of the LED element.

In certain embodiments as otherwise described herein, each of the support clips is positioned directly under a respective LED of the LED element. For example, as shown in FIG. 2, the LED element 140 is positioned on the support clips 150 so that a respective LED is disposed directly over each support clip. In LED element 140, an additional LED is also positioned between each support clip 150. In other embodiments, a support clip is provided under every LED in the LED element. The positioning of the LEDs over the support clips promotes the dissipation of heat generated by the LEDs through the support clips.

In certain embodiments as otherwise described herein, the support clips extend through the base of the housing so as to form a thermal conductor to the mounting surface of the housing. In some embodiments, the support clips extend through the housing base so as to provide thermal communication with another conductive surface. For example, support clips 150 in lighting fixture 100 extend through base 120 and are in thermal communication with the ceiling support beam 180. In other embodiments, the support clips contact a thermally conductive element disposed within the base, which dissipates heat to another component or to the surrounding environment. To promote heat transfer between the LED element and the support clips, in some embodiments, the LED element is attached to the support clips using a thermal adhesive or thermal paste.

Figure 5A:
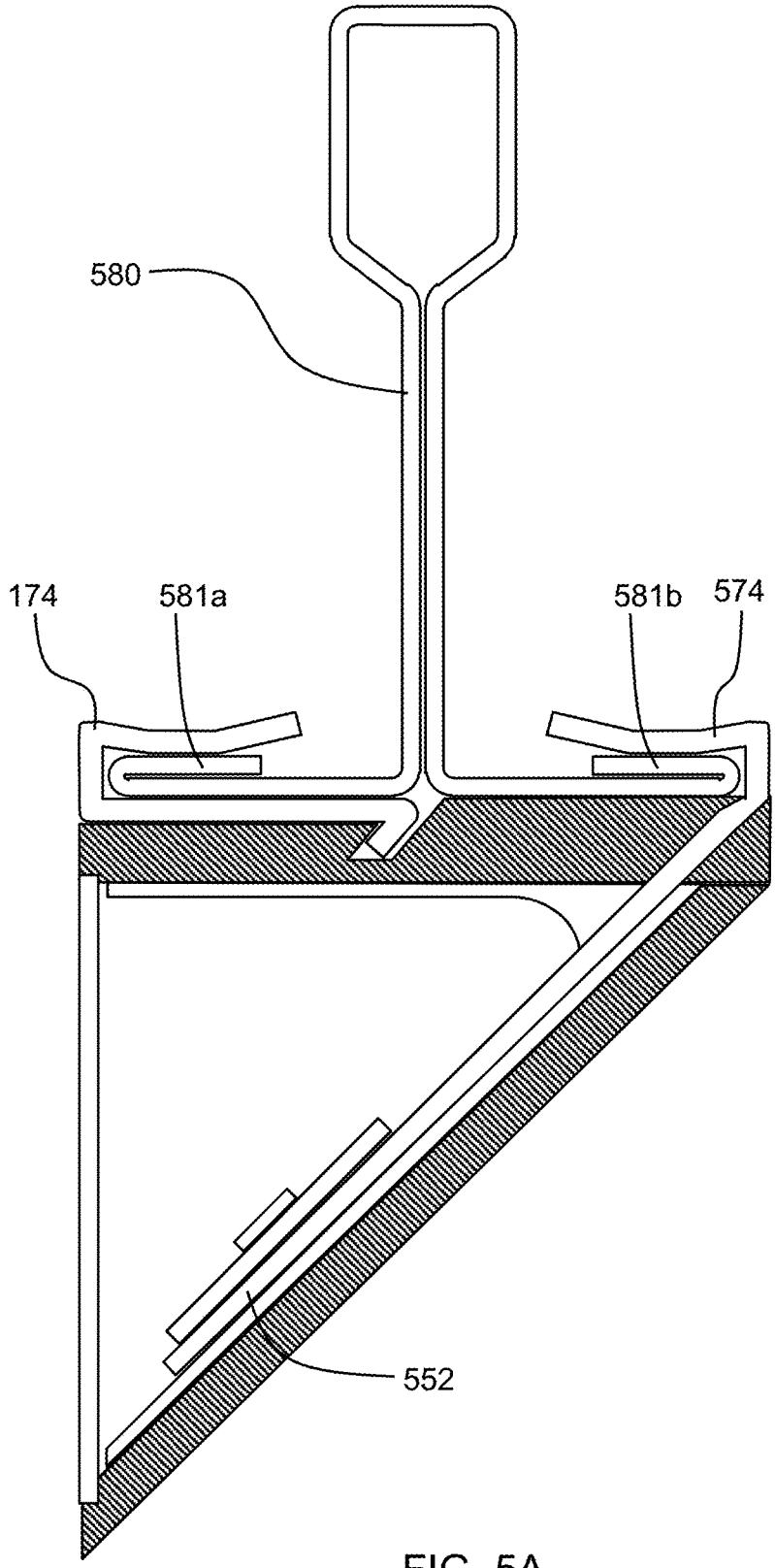
FIG. 5A is a schematic cross section of a light fixture according to another embodiment of the disclosure.

While the support clip can be configured as a separate item from the attachment clip, in other embodiments the support clip is formed as part of the attachment clip, e.g., with a support leg as described above extending from the attachment clip. Such an embodiment is shown in FIG. 5A. Here, attachment clip 574 not only engages the flange 581*b* of the support beam 580, but also includes a support leg 552 that supports the LED as described above. Advantageously, this can help conduct heat from the LED to the support beam. In certain embodiments, and as shown in FIG. 5A, a second clip 574 can be used to attach the housing to the other flange 581*a* of the support beam.

In certain embodiments as otherwise described herein, the lighting fixture further includes a window enclosing the open side of the housing. For example, as shown in FIG. 1, lighting fixture 100 includes window 160 positioned to enclose the open side 116 of housing 110. Window 160 encloses housing 110 and provides protection for the electrical components inside lighting fixture 100.

In certain embodiments as otherwise described herein, the window includes a lens. In some embodiments, the lens is configured to direct the light in a desired direction. For example, in some embodiments the lens directs light emitted from the light source in an upward direction. In some embodiments, where the light source is an LED element, the lens can operate cooperatively with the angle of the LED element to project the light in any of a range of angles. In some embodiments, the lens includes refractive optics to bend the light in a desired direction. In other embodiments the lens includes diffractive optics to direct the light. In certain embodiments as otherwise described herein, the window includes a diffuser. The diffuser scatters the light and reduces the intensity of light emitted from the lighting fixture in any one direction. In some embodiments, the window includes a plurality of layers. For example, in some embodiments, the window includes a diffuser layer and a lens layer. In other embodiments, the window includes two lens layers, including both a lens layer with diffractive optics and a lens layer with refractive optics. In certain embodiments as otherwise described herein, the window is attached to the housing using clips.

As will be appreciated by those of ordinary skill in the art, the lens may be attached to the housing in a variety of different manners. For example, in certain embodiments, the window is disposed in grooves within the housing. In particular, in some embodiments, the housing is formed in two pieces and the window is inserted into the grooves before the pieces of the housing are fixedly attached, for example using mechanical fasteners. In other embodiments, the opening of the housing is spread open using an outward force and the window is inserted into the grooves before the force is removed. In other embodiments, the window includes clips that engage with corresponding structure on the housing.

In certain embodiments as otherwise described herein, the lighting fixture includes light piping extending between the light source and the window so as to provide light in corner regions of the window. For example, in some embodiments, the light source extends over only a portion of the length of the housing and the light piping carries the light to sections of the housing that are remote from the light source.

Figure 11:
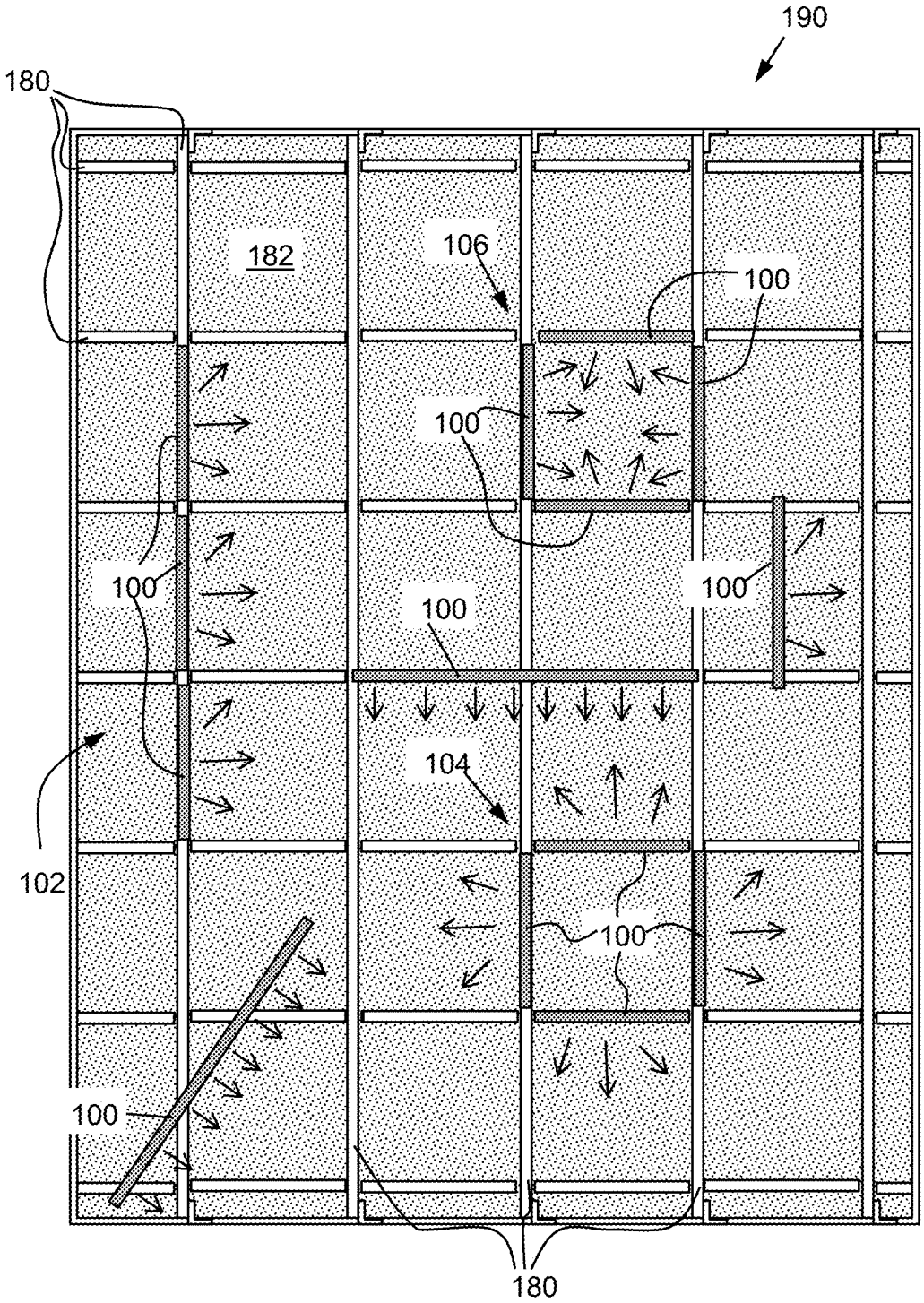
FIG. 11 is a schematic bottom view of a ceiling system including several lighting fixtures according to FIG. 1.

In another aspect, the disclosure provides a suspension ceiling lighting system including a suspension ceiling with a plurality of support beams arranged in rows and columns to form a ceiling grid, and a lighting fixture according to any of the above embodiments. Such a suspension ceiling lighting system is shown in FIG. 11. System 190 includes a ceiling grid with a plurality of support beams running perpendicular to one another. A first portion of the support beams run along the length of the ceiling and a second portion run across the width of the ceiling. The grid of support beams provides an array of openings to receive ceiling tiles 182 disposed therein. Lighting system 190 includes a plurality of lighting fixtures 100 attached to the ceiling grid. In particular, system 190 includes 8 lighting fixtures attached to the support beams 180 of the ceiling grid. In other embodiments, the lighting system includes other numbers of lighting fixtures, or a single lighting fixture.

In certain embodiments as otherwise described herein, the lighting fixture is attached to a first support beam of the ceiling grid and extends in a direction that is parallel to the first support beam. For example, as shown in FIGS. 2-5, lighting fixture 100 is attached to support beam 180 and extends in a direction that is parallel to the support beam. This configuration allows lighting fixture 100 to be supported by support beam 180 along the entire length of the lighting fixture. Furthermore, when viewed by observers from below, the lighting fixture visually blends in with the ceiling structure because it is aligned with the ceiling grid. In particular, the base 120 of housing 110 of lighting fixture 100 includes a retainer 124 in the shape of a dovetail recess. Retainer 124 engages with two clips 174 that are attached to support beam 180. Each of the clips includes a hook portion 175 that cooperate to engage with the dovetail recess of retainer 124. In other embodiments, the lighting fixture is disposed at an angle to the support beam. For example, in some embodiments, the lighting fixture crosses one or more support members of a ceiling grid at an angle.

Figure 5B:
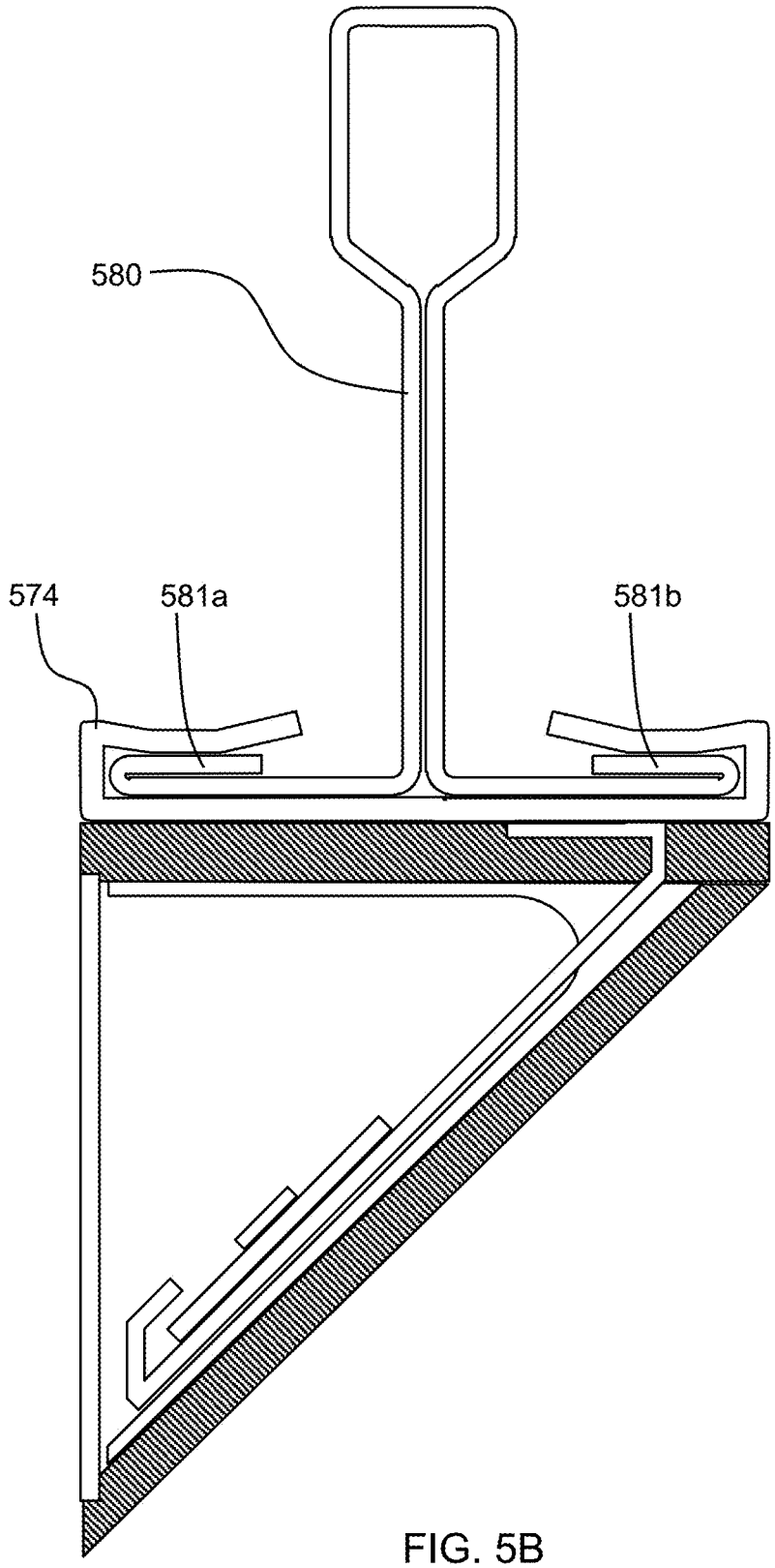
FIG. 5B is a schematic cross section of a light fixture according to another embodiment of the disclosure.
Figure 5C:
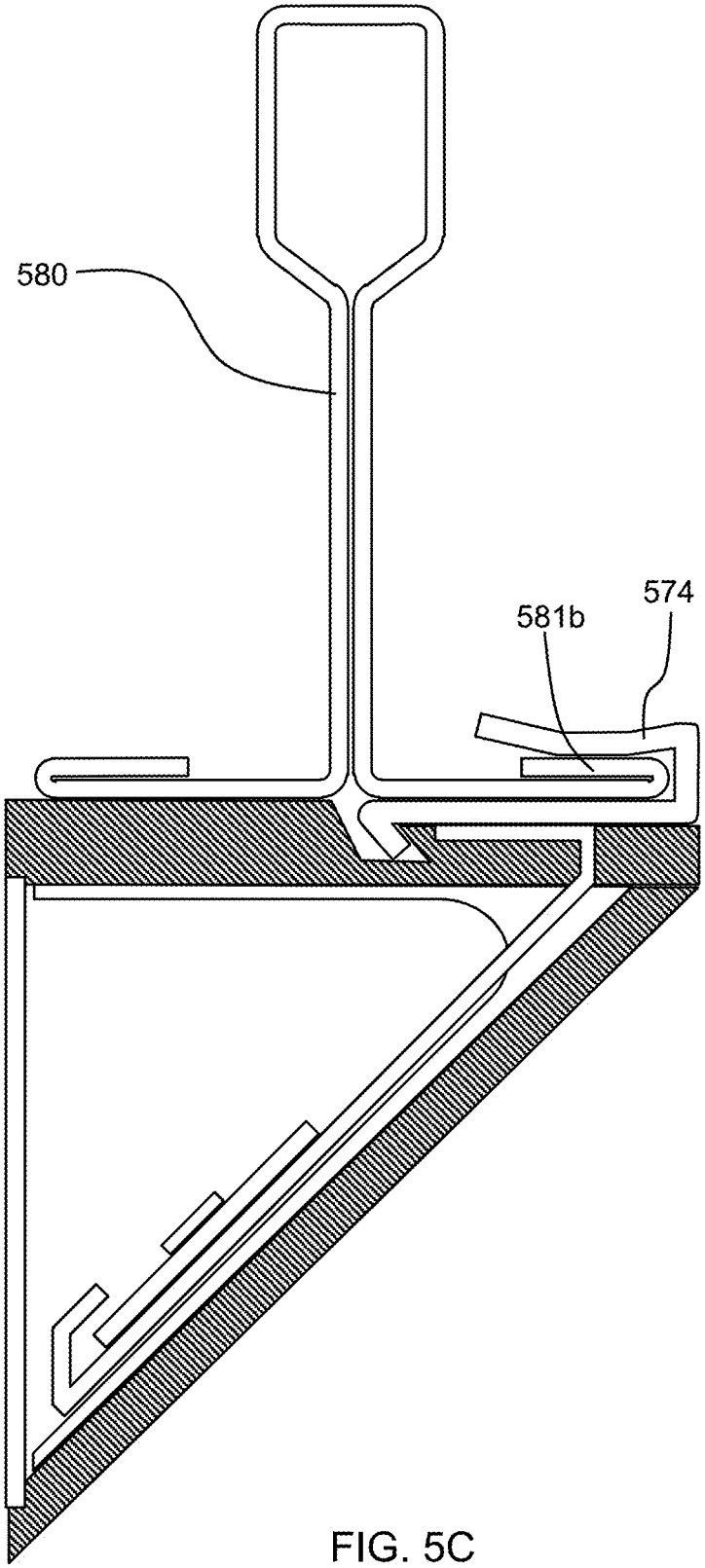
FIG. 5C is a schematic cross section of a light fixture according to another embodiment of the disclosure.

The embodiments of FIGS. 1-5 show two separate clips 174, each interacting with one of the opposing flanges of the support beam. However, in other embodiments a single support clip is used at each clipped position along the support beam. Such a single-piece support clip 574 can interact with both opposing flanges 581*a*, 581*b* of a ceiling support beam 580, as shown in FIG. 5B. In such cases, the single-piece support clip can, for example, be slid onto a support beam from an end thereof. In other embodiments, such a support clip can interact with only one of the flanges at each clipped position along the support beam, as shown in FIG. 5C. This can be done in an alternating fashion along the lengths of a lighting fixture and a support beam, for example.

In certain embodiments as otherwise described herein, the lighting fixture is substantially the same width as the first support beam. As a result, the lighting fixture and the ceiling grid support beams can appear the similar from below. The phrase substantially the same width, as used herein, refers to a difference in width of no more than 20%. In certain embodiments as otherwise described herein, a width of the lighting fixture is no more than 10% wider than the first support beam. Further, in certain embodiments as otherwise described herein, the width of the lighting fixture is in a range from 0% to 10% wider than the first support beam. With the width of the lighting fixture slightly larger than the width of the ceiling grid support beams, the lighting fixture can conceal the entire width of the support beam but still appear to be the same size as the support beam.

In certain embodiments as otherwise described herein, the system includes a plurality of lighting fixtures according to the disclosure that are attached to the ceiling grid. For example, in some embodiments the lighting fixtures are arranged in a particular pattern to enhance the lighting of the space being illuminated. In other embodiments, the pattern of the lighting fixtures provides a desired architectural feature.

In certain embodiments as otherwise described herein, a group of the plurality of lighting fixtures is arranged in a line along one column of the ceiling grid. For example, in some embodiments, several lighting fixtures are attached to one continuous support beam of the ceiling grid. In some embodiments, the lighting fixtures are oriented such that the open side of the housing of each lighting fixture faces the same direction, and thus shine light in the same direction. For example, system 190 shown in FIG. 11 includes a group 102 of lighting fixtures 100 that are arranged in a line with the open side of the respective housings facing in one direction so as to shine light in the same direction. In other embodiments, the lighting fixtures are oriented to shine light in opposing directions.

In certain embodiments as otherwise described herein, a group of four of the plurality of lighting fixtures is arranged in a rectangle, with the open side of each of the group of four lighting fixtures arranged on the outside of the rectangle. For example, system 190 includes a group 104 of four lighting fixtures 100 that is arranged in a square. Each of the lighting fixtures is oriented with the open side of the housing on the outside of the square, such that the light projects outward from the four lighting fixtures. Surprisingly, the inventors have determined that such a configuration creates a central ceiling tile that appears to float at a distance from the surrounding ceiling tiles.

In certain embodiments as otherwise described herein, a group of four of the plurality of lighting fixtures is arranged in a rectangle, with the open side of each of the group of four lighting fixtures arranged on the inside of the rectangle. For example, system 190 includes a group 106 of four lighting fixtures 100 that are arranged in squares. Each of the lighting fixtures is oriented with the open side of the housing on the inside of the square, such that the light projects inward from the four lighting fixtures.

Other embodiments, of course, are possible. FIG. 11 shows alternative configurations in which the lighting fixtures 100 span across two or more members of the ceiling grid, either orthogonal to the grid members (e.g., center right of FIG. 11); or at a non-orthogonal angle (e.g., at the bottom left of FIG. 11).

As described above, the present inventors have noted that conventional ceiling lights are costly and complicated to install. The present inventors have thus also developed a lighting attachment assembly that is attractive and easy to install.

Accordingly, another aspect of the disclosure is a ceiling accessory, such as a lighting assembly (e.g., as in any embodiment described above with respect to any of FIGS. 1-11) including a housing having an upper surface and forming a cavity below the upper surface, a light source disposed in the cavity of the housing, and first and second clips configured to respectively attach to first and second flanges of a ceiling support beam. Each of the first and second clips include an upper arm configured to engage an upper surface of the respective flange, a lower arm connected to the upper arm by a joint and configured to engage a lower surface of the respective flange, and a retainer disposed on the lower arm. The retainer is configured to engage the upper surface of the housing such that the housing is held up by the respective retainers of the first and second clips and such that lateral movement of the first and second clips is inhibited. Such a lighting assembly is shown in cross section in FIG. 1. Lighting assembly 1210 is part of a lighting system 1200. The lighting assembly includes a housing 1212 including an upper surface 1214 for mounting the assembly against a building surface. Housing 1212 is enclosed so as to form a cavity 1215 therein. A light source 1260 is disposed within cavity 1215. Assembly 1210 also includes first and second clips 1232, 1234 for attaching the assembly to a support beam 1280 of a ceiling grid. Each of the clips includes an upper arm 1236 that engages an upper surface of a corresponding flange 1282, 1284 of support beam 1280 and a lower arm 1238 that engages a lower surface of the corresponding flange 1282, 1284. Upper arm 1236 and lower arm 1238 are connected by a joint 1237. Each of the clips 1232, 1234 also includes a retainer 1250 that is configured to engage the upper surface 1214 of housing 1212. Through the engagement between the respective retainers 1250 and the upper surface 1214 of housing 1212, the housing is held up against the support beam 1280 and the first and second clips 1232, 1234 are inhibited from sliding off the respective first and second flanges 1282, 1284 of support beam 1280.

In certain embodiments as otherwise described herein, the retainer of each of the first and second clips includes a projection. In some embodiments, each of the projections is formed as a hook. The term hook, as used herein, indicates that the projection extents in both the vertical direction and in a lateral direction. Accordingly, the projection is able to extend down past a corresponding structure of the housing based on the vertical extension and then also extend under the corresponding structure of the housing based on the lateral extension in order to provide upward support of the housing. For example, the projections forming each of the retainers 1250 in assembly 1210 include a vertical extension such that they extend below upper surface 1214 and a lateral extension such that they hook under a portion of housing 1212 and support the housing.

Figure 13:
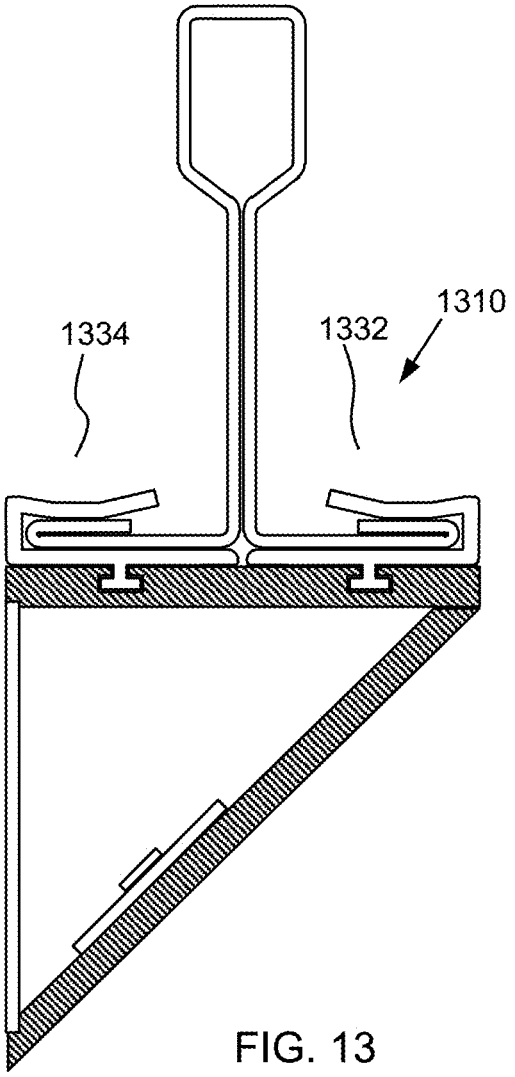
FIG. 13 is a schematic cross-sectional side view of a lighting assembly according to another embodiment of the disclosure.

While the hooked projections in assembly 1210 include a lateral extension in only one direction, in some embodiments, the lateral extension of the projection is formed in more than one direction. In some embodiments, the projection includes a circumferential lateral extension. For example, in some embodiments, the projection is in the form of a nail head with a lateral extension that is provided around the end of the projection so as to hook behind a surface of the housing. Such a projection is shown in assembly 1310 in FIG. 13. The projection of the retainer 1350 of each of the first and second clips 1332, 1334 is formed as a nail head that fits into a corresponding T-shaped recess to provide upward support to the housing.

In certain embodiments as otherwise described herein, the housing includes a first recess that cooperates with the projection of the first clip to form a linked connection between the first clip and the housing and a second recess that cooperates with the projection of the second clip to form a linked connection between the second clip and the housing. For example, housing 1212 includes a first recess 1222 that cooperates with the retainer projection 1250 of first clip 1232. In particular, projection 1250 extends into first recess 1222 and underneath a portion of housing 1212. Therefore, projection 1250 of the first clip 1232 is able to provide upward support to the housing from within first recess 1222. Likewise, projection 1250 of second clip 1234 similarly extends into second recess 1224 so as to provide upward support to the housing 1212 from within second recess 1224.

In certain embodiments as otherwise described herein, each of the recesses includes an inward facing wall that abuts the projection of the respective clip to prevent outward lateral movement of the respective clip. For example, first recess 1222 includes an inward facing wall 126 that is adjacent to projection 1250 of first clip 1232. The term inward, as used herein, is in reference to the center of the lighting assembly with respect to the depicted cross section. Thus, the inward facing wall faces the lateral center of the lighting assembly. Wall 1226 abuts projection 1250 and prevents the projection from moving laterally outward. Accordingly, first clip 1232 is likewise prevented from lateral outward movement, and thus the clip is securely attached to the support beam 1280. Second recess 1224 has a similar inward facing wall 128 that abuts the projection 1250 of second clip 1234. Like wall 1226, wall 1228 prevents second clip from lateral movement off the support beam 1280.

In certain embodiments as otherwise described herein, the projection of each of the clips is disposed at an inner end of the respective lower arm. In certain embodiments, the projection of the first clip is adjacent to the projection of the second clip. For example, each of the projections 1250 of the first and second clips 1232, 1234 is positioned at the laterally inner end of the respective lower arm 1238 away from the respective joint 1237. Further, the two projections meet at the lateral middle of the lighting assembly where the inner ends of each clip 1232, 1234 are adjacent. The neighboring projections 1250 combine to form a dovetail projection.

In certain embodiments as otherwise described herein, the first recess and second recess are disposed on lateral sides of a slot that extends along the length of the housing, and the projections of both the first and second clips are disposed in the slot. For example, both the first recess 1222 and the second recess 1224 are disposed within slot 1220, which holds the retainers 1250 of each of the first and second clips. Thus, the two recesses are combined to each engage the respective clip at the location where the projections of the two clips meet.

Figure 14:
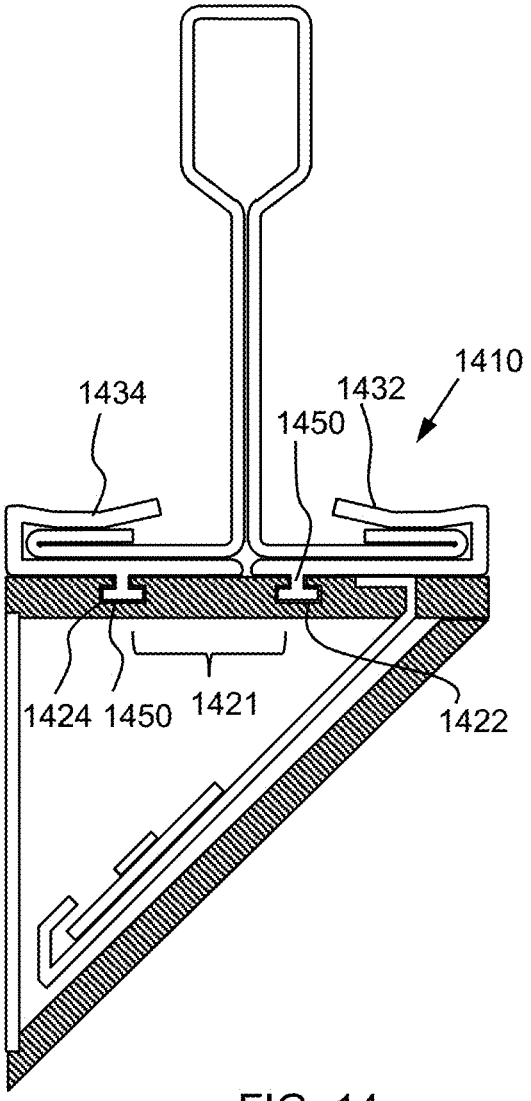
FIG. 14 is a schematic cross-sectional side view of a lighting assembly according to another embodiment of the disclosure.

While the two recesses 1222, 1224 of assembly 1210 are joined in the same slot 1220, in some embodiments the recesses are separated. In particular, in certain embodiments as otherwise described herein, a portion of the housing separates the first recess and the second recess. For example, in lighting assembly 1310, the first recess 1322 and second recess 1324 are separated by a portion 1321 of the housing. Likewise, in the embodiment of FIG. 14, the first and second recesses 1422, 324 in lighting assembly 1410 are also separated by a portion 1421 of the housing.

In certain embodiments as otherwise described herein, the first clip and the second clip are symmetrical. For example, in each of lighting assembly 1210 and lighting assembly 1310, the respective first clips 1232, 1332 are symmetrical to the respective second clips 1234, 1334. In both cases, the support beams are symmetrical and the first and second clips attach to the flanges of the support beams in a symmetrical fashion. Furthermore, in both cases, the recesses of the housing that engage with the projections of the clips are also symmetrical.

In other embodiments, the first clip and the second clip are asymmetrical. For example, in lighting assembly 1410, the first and second clips 1432, 1434 are asymmetrical. In particular, the retainer 1450 of first clip 1432 is positioned further inward than the retainer 1450 of second clip 1434. The position of the retainer of first clip 1432 is made to accommodate an LED support clip, as described in further detail below.

Figure 15:
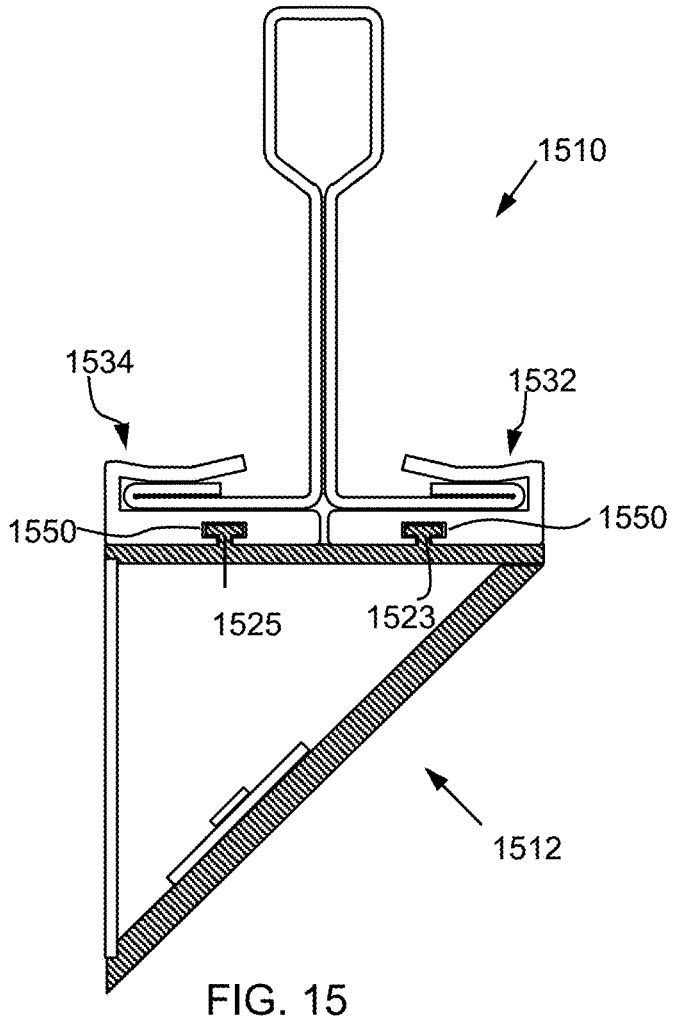
FIG. 15 is a schematic cross-sectional side view of a lighting assembly according to yet another embodiment of the disclosure.

In certain embodiments as otherwise described herein, the retainer of each of the first and second clips includes a recess. Thus, in contrast to lighting assembly 1200, where the retainer is formed as a projection 1250 and the housing 1212 includes a recess to cooperate with the projection, in some embodiments, the retainer of each clip is a recess and the housing includes a projection that cooperates with the recess. Such a lighting assembly is shown in FIG. 15. Lighting assembly 1500 includes first and second clips 1532, 1534 that each includes a retainer 1550 in the form of a recess. To cooperate with the recessed form of the retainers, the housing includes structure to engage the recesses of the clips 1532, 1534.

In certain embodiments as otherwise described herein, the housing includes a first projection and second projection, where the first projection cooperates with the recess of the first clip to form a linked connection between the first clip and the housing and the second projection cooperates with the recess of the second clip to form a linked connection between the second clip and the housing. For example, housing 1512 of lighting assembly 1510 includes first and second projections 1523, 1525 that cooperate, respectively, with the recesses 1550 of first clip 1532 and second clip 1534 in order to form a linked connection between the housing and each of the clips. In particular, the projections 1523, 1525 are formed with circumferential lateral projections, similar to a nail head, and the recesses of the clips 1532, 1534 are configured as T-shaped slots to receive the projections. Once the projections are disposed in the corresponding slots, downward movement of the housing is inhibited.

In some embodiments, the retainers of the first and second clips can have different configurations. For example, in some embodiments, the retainer of one of the clips includes a recess, and the retainer of the other clip includes a projection.

In addition to those described above, the retainer can have a variety of different forms, as will be understood by those of ordinary skill in the art. For example, in some embodiments, the retainer is configured as a snap fit connection. In other embodiments, the retainer is configured as a recloseable fastener.

Figure 16:
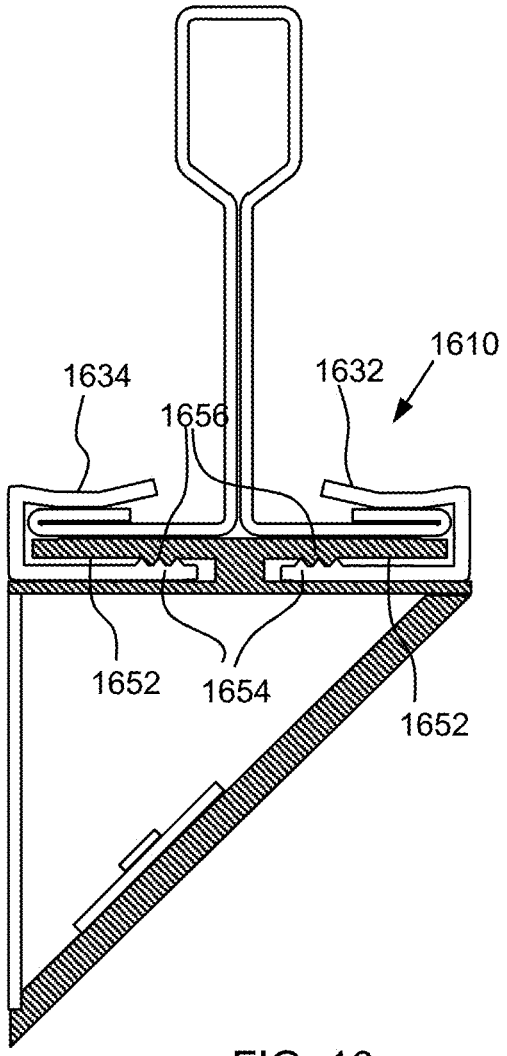
FIG. 16 is a schematic cross-sectional side view of a lighting assembly according to still another embodiment of the disclosure.

In certain embodiments as otherwise described herein, the lower arm of each of the first and second clips engages a slot in the base of the housing. For example, in lighting assembly 1610, shown in FIG. 16, the lower arms 1638 of each of the first and second clips 1632, 1634 are inserted into slots 1652 that extend horizontally inward from the sides of the base 1616 of the housing. As a result, the clips hold up the lighting housing with the ends of the lower arms acting as the respective retainers.

In certain embodiments as otherwise described herein, the lower arm of each of the first and second clips includes a tooth and the slot includes a catch configured to engage the tooth and retain the lower arm in the slot. For example, in lighting assembly 1610 shown in FIG. 16, the lower arms 1638 of each of the first and second clips 1632, 1634 include teeth 1654 that engage with catches 1656. Once the lower arm 1638 of each clip is inserted into the respective slot 1652, the teeth 1654 engage with the catches 1656 to prevent the clip from being easily withdrawn from the slot 1652.

In certain embodiments as otherwise described herein, the upper arm and lower arm of each of the clips are spaced apart by the joint. For example, joint 1237 of the first and second clips 1232, 1234 hold the respective upper and lower arms 1236, 1238 at a distance from one another so that the clips can fit over the respective flanges 1282, 1284 of the support beam 1280. In some embodiments, the distance between the upper and lower arms when the clip is in a relaxed state is slightly smaller than the thickness of the flanges. Accordingly, the clip provides a pinching force on the upper and lower surfaces of the respective flange to maintain a strong engagement between the clip and the flange. In some embodiments, the pinching force is also advantageous for promoting thermal contact and heat transfer between the clip and the flange. In some embodiments, the pinching force promotes electrical contact between a conductive element of the clip and a corresponding element disposed on or forming part of the flange.

In certain embodiments as otherwise described herein, an inner end of the upper arm of each of the clips flares away from the lower arm. For example, the inner end 1239 of the upper arm 1236 of each of the first and second clips 1232, 134 flare upward and away from the lower arm 1238. The flared end of the upper arm widens the gap between the two arms of the clip, which promotes insertion of a flange when the clip is placed on a receiving support beam.

In some embodiments, the housing includes an end cap at one or both ends that engages the clips. For example, in some embodiments, at the ends of the housing, an end cap extends up from the base to engage the clips. Accordingly, while the retainers prevent lateral movement of the clips off the flanges, the end caps prevent longitudinal movement of the clips.

In certain embodiments as otherwise described herein, each of the first clip and the second clip is formed of metal. For example, in some embodiments, the clips are formed of aluminum. In other embodiments the clips are formed of steel. Other metals, as well as other materials, are also possible as will be appreciated by those of ordinary skill in the art.

In certain embodiments as otherwise described herein, the housing is formed of plastic. For example, in some embodiments the housing is formed of polycarbonate. In other embodiments, the housing is formed from other materials.

In certain embodiments as otherwise described herein, a width of the housing is no more than 6 inches, e.g., no more than 2 inches. In certain embodiments, the width of the lighting housing is in a range from ½ inch to 1-½ inches, e.g. between ¾ inch and 1-¼ inches. Within this range, as explained in more detail below, the width of the housing can approximate the width of a corresponding support beam of the ceiling grid. Accordingly, the lighting housing and entire lighting assembly can blend in with the ceiling, and even go unnoticed when the light source is not illuminated.

In certain embodiments as otherwise described herein, a length of the housing is in a range from 18 to 55 inches, e.g., about 24 inches or e.g., about 48 inches. For example, in some embodiments, the length of the light housing corresponds to the length of a neighboring ceiling tile within a suspension ceiling in which the lighting assembly is installed. The coordination of the lighting assembly length and the ceiling tile length allows for beneficial lighting designs.

In certain embodiments as otherwise described herein, the light source includes a light emitting diode LED element comprising a plurality of LEDs. The term LED as used herein includes conventional LEDs, organic light emitting diodes (OLEDs) and quantum dot LEDs. For example, light source 1260 in lighting assembly 1210 includes an LED strip 162 having a row of LEDs attached to a flexible circuit board. In other embodiments, the LED element includes an array of LEDs on a panel or other structure. Alternatively, the light source may take a variety of different forms, as will be appreciated by those of ordinary skill in the art. For example, the light source may be in the form of a lamp, such as an incandescent, fluorescent or halogen bulb. The light source may also be a laser light source or another light source.

In some embodiments, the housing includes a base and cover extending over the base. For example, the housing 1212 of lighting assembly 1212 includes a base 1216 and a cover 1218 in the form of an elongate wall that is disposed at an angle to the base so as to provide the cavity for the light source within the housing 1212. The LED element 1262 of lighting assembly 1210 is positioned adjacent to the elongate wall in order to emit light in an upward direction. The term "upward direction," as used herein, includes any direction with an upward component. In other words, any direction with an angle above the horizontal is one that is directed in an "upward direction." In certain embodiments, the center of a light beam emitted from the light source is directed in the upward direction. In some embodiments, substantially all of the light emitted from the light source is directed in an upward direction. The phrase "substantially all of the light," as used herein, means at least 75% of the light emitted from the assembly.

Figure 17:
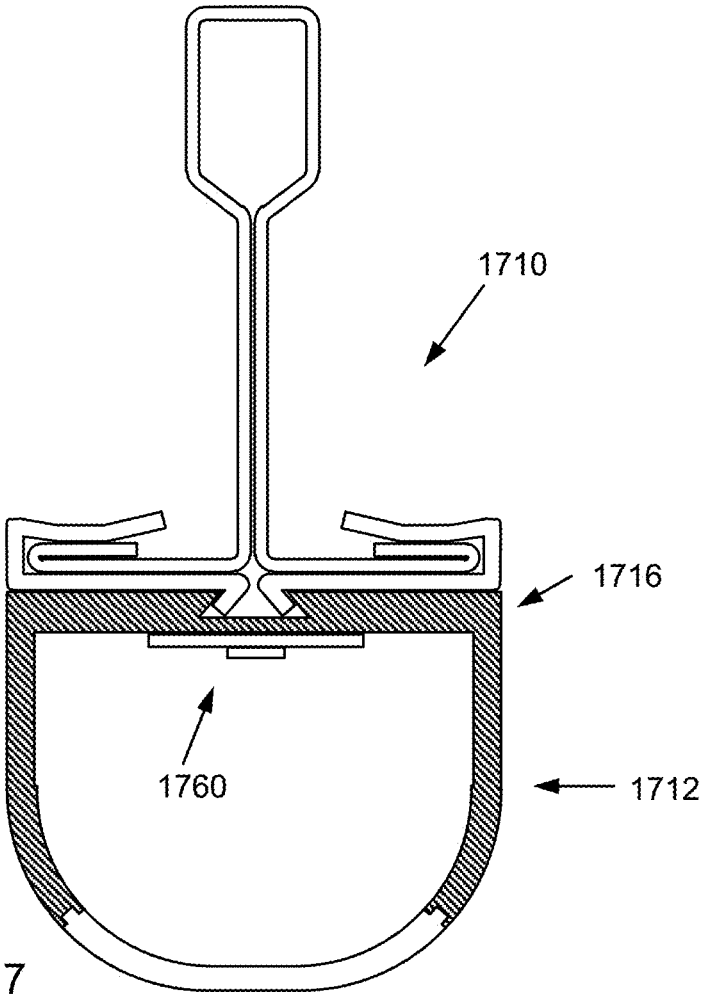
FIG. 17 is a schematic cross-sectional side view of a lighting assembly according to another embodiment of the disclosure.

In other embodiments, the light housing and light source have another configuration. For example, in lighting assembly 1710 of the embodiment of FIG. 17, housing 1712 is in the form of an elongate light with a curved lower section. Light source 1760 is positioned along the base 1716 at the top of housing 1712 so as to direct light in a downward direction. In some embodiments, the housing includes a base and a removable cover. In certain embodiments various covers are interchangeable with the base to provide various lighting arrangements.

Figure 18:
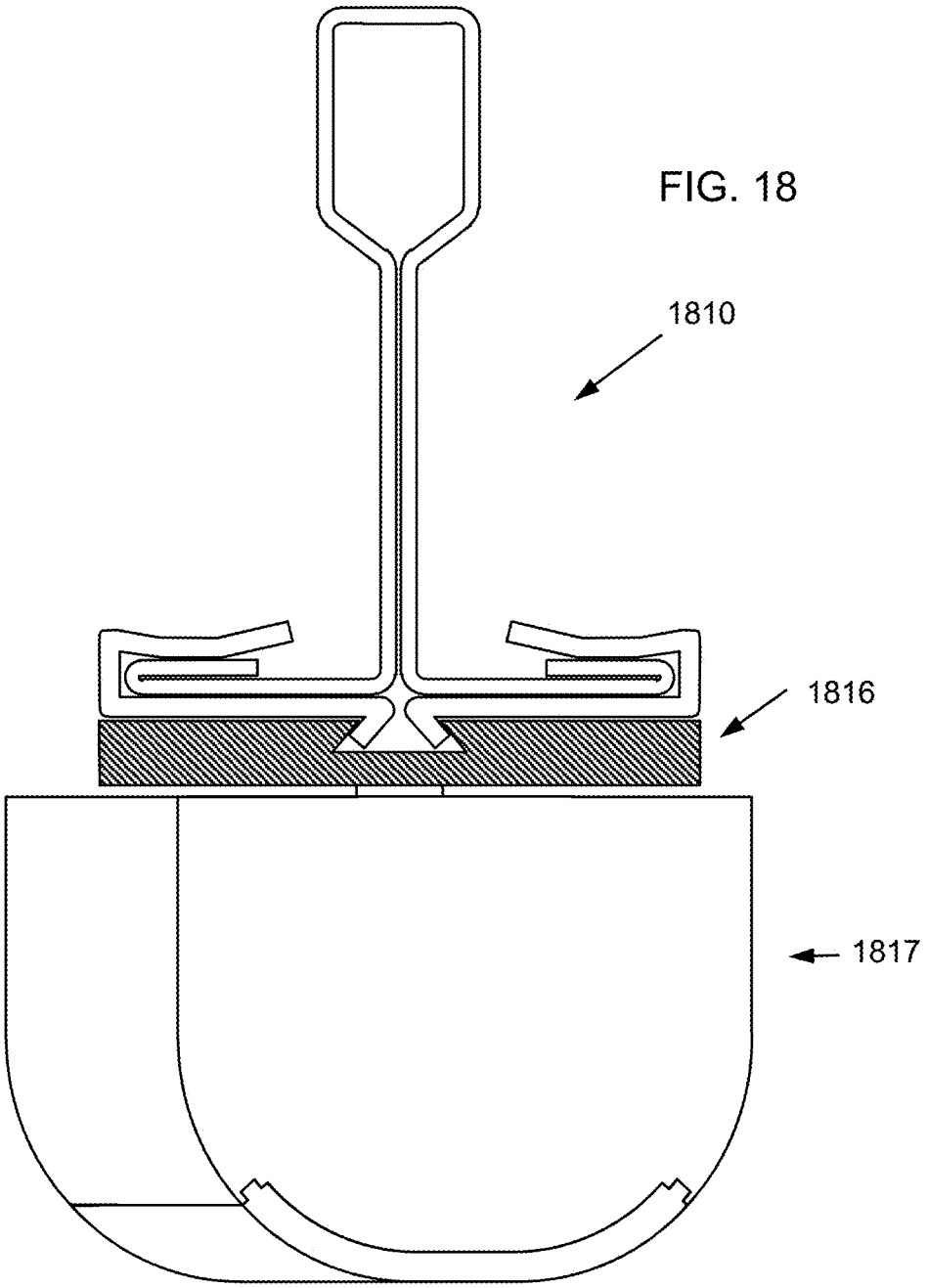
FIG. 18 is a schematic cross-sectional side view of a lighting assembly according to another embodiment of the disclosure.

In some embodiments, at least a portion of the light housing is disposed at an angle to the longitudinal direction of the clip and corresponding ceiling grid member. For example, the housing 1817 of lighting assembly 1810 of the embodiment of FIG. 18 includes a lighting enclosure 1817 disposed at an angle to the base 1816. The light source of the assembly is provided within the enclosure. In some embodiments, the enclosure is rotatable with respect to the base. For example, enclosure 1817 is rotatable through a plane that is parallel to the support beam. Accordingly, enclosure 1817 can be pivoted to an orientation where the light source is at an angle to the ceiling grid support beams.

In certain embodiments as otherwise described herein, the lighting assembly further includes a support clip disposed in the cavity of the housing, wherein the LED element is attached to the support clip. In certain embodiments as otherwise described herein, the support clip abuts the first clip so as to provide thermal communication between the LED element and the first clip. For example, lighting assembly 1210 includes a plurality of support clips 1240 that support LED element 1262 within housing 1212. Each of the support clips includes a support leg 1242 that extends into cavity 1215 of the housing and holds the LED element 1262. Further the support legs 1242 are attached to a base leg 1244 that is adjacent to the base 1216 of the housing 1212. In particular, the support clip 1240 extends through base 1216 such that the base leg 1244 abuts the first clip 1232 and provides thermal communication between the LED element 1262 and the first clip 1232. Accordingly, heat generated by the LED element is conducted through the support clip and first clip to support beam 1280 of the ceiling grid, where the heat is dissipated.

Figure 20:
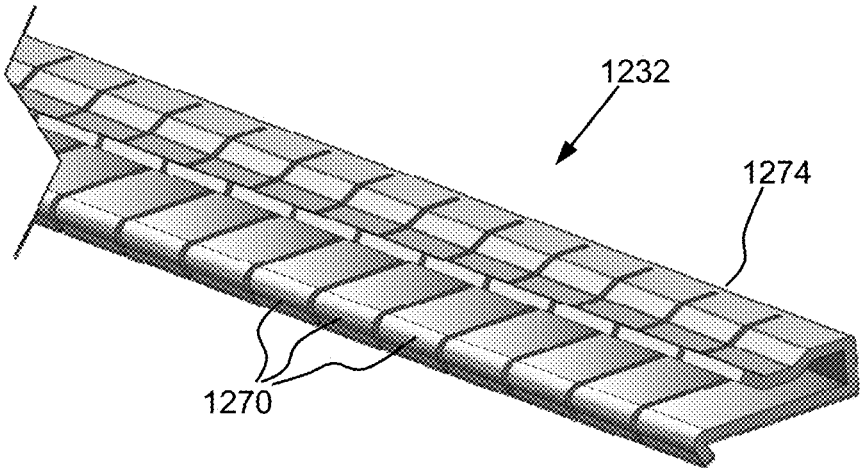
FIG. 20 is a schematic perspective view of a ceiling clip according to another embodiment of the disclosure.

In certain embodiments as otherwise described herein, each of the first clip and second clip includes a row of clip sections along the length of the lighting assembly. For example, as shown in FIG. 20, first clip 1232 is an elongate member formed by a plurality of clip sections 1270 formed along its length. Each of the clip sections 1270 includes a section of upper arm 1236 and a section of lower arm 1238. The clip sections 1270 are defined by a plurality of breaks along the length of the clip 1232 separating each clip section from the adjacent clip sections. Second clip 1234 has an identical construction. In some embodiments, the first and second clips each extend along the entire length of the lighting housing. In other embodiments, one or both clips is shorter than the lighting housing.

In certain embodiments as otherwise described herein, the clip sections are attached by a bridge. For example, clip sections 1270, which are largely separated from one another by breaks, are interconnected by a bridge 1274 provided between each of the sections. Bridge 1274 is provided along the joint 1237 of the clip. In other embodiments, the bridge connects other portions of the clip sections, such as the upper arm or the lower arm. The separation between clip sections allows the clip to be flexible and bend along its length. In some embodiments, the bridge creates the appearance of a continuous surface, such that breaks in the clip are not visible when the lighting assembly is installed on the ceiling grid. Moreover, the bridge of material connecting the clip sections is small and can be easily broken by a person installing the clip. Accordingly, the installer can select the length of the clip by detaching the desired number of clip sections from a long row of the clip sections. In some embodiments, the cross sectional area of the bridge is less than 20% of the cross sectional area of the clip, e.g., less than 10% of the cross sectional area, e.g., less than 5%.

Figure 12:
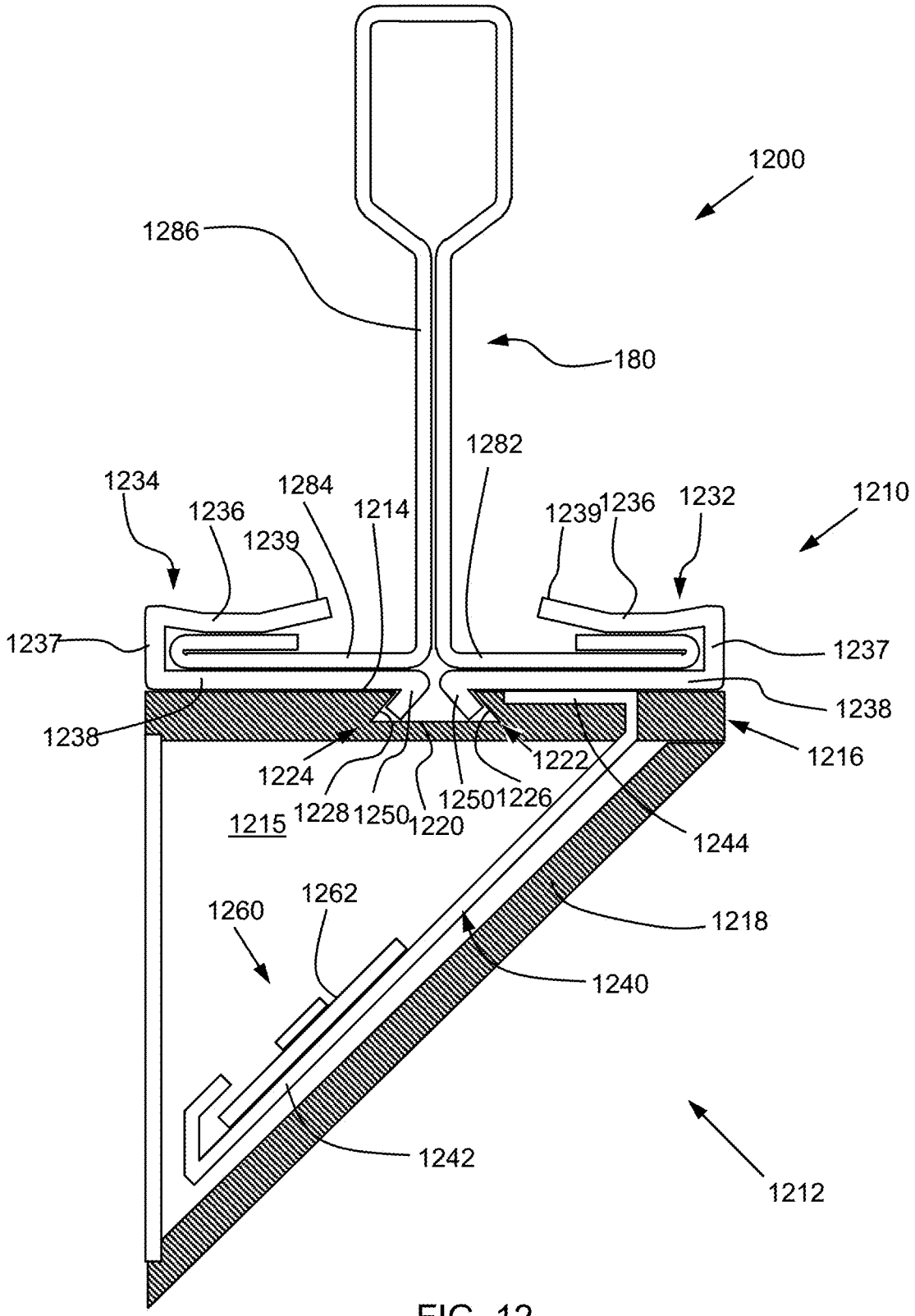
FIG. 12 is a schematic cross-sectional side view of a lighting assembly attached to a ceiling support beam according to an embodiment of the disclosure.

In another aspect, the disclosure provides a lighting system comprising a ceiling structure including a support beam having a vertical web, and opposing first and second flanges extending laterally outward from a lower end of the vertical web. Each of the first and second flanges include an upper surface and a lower surface. A lighting system according to any of the above embodiments is attached to the support beam. The first and second clips of the lighting assembly are respectively attached to the first and second flanges of the support beam, with the upper arm of each clip engaging the upper surface of the respective flange and the lower arm of each clip engaging the lower surface of the respective flange so as to retain the lighting assembly on the support beam. Such a system is shown in FIG. 12. Lighting system 1200 includes a support beam 1280 including a vertical web 1286 and first and second flanges 1282, 1284 extending laterally outward from the lower end of vertical web 1286. The first clip 1232 of lighting assembly 1200 is attached to the first flange 1282 of support beam 1280 with the first flange disposed between the upper and lower arms 1236, 138 of first clip 1232, such that upper arm 1236 engages an upper surface of first flange 1282 and lower arm 1238 engages a lower surface of first flange 1282. Likewise, the second clip 1234 is attached to the second flange 1284 with the second flange disposed between the upper and lower arms 1236, 1238 of the second clip, such that upper arm 136 engages an upper surface of second flange 184 and lower arm 1238 engages a lower surface of second flange 1284. Moreover, the retainers 150 of each clip 1232, 1234 hold the housing 1212 in place such that the entire lighting assembly 1210 is attached to the support beam 1280.

In certain embodiments as otherwise described herein, the upper and lower arms of each of the clips apply a clamping force against the upper and lower surfaces of the respective flange of the support beam. For example, the upper and lower arms 1236, 1238 of each of the first clip 1232 and second clip 1234 apply a clamping force, respectively, against first flange 1282 and second flange 1284. While joint 1237 holds upper and lower arms 1236, 1238 at a distance from one another, the distance between the arms when the clips are in a relaxed state, i.e., not applied over the respective flange 1282, 1284, is smaller than the thickness of the flange. Accordingly, positioning the clips over the respective flange requires that the arms be spread apart, such that an elastic force presses the arms 1236, 1238 against the flange when it is held within the clip.

In certain embodiments as otherwise described herein, the first and second flanges each include a folded hem, and the upper arm of each of the first and second clips applies the clamping force against the respective folded hem. For example, each of the first and second flanges 1282, 1284 of support beam 1280 include a folded hem at an outer edge thereof. With the clips 1232, 1234 in place over the respective flanges 1282, 1284, the upper arm 1236 presses against the folded hem section of the respective flange.

In certain embodiments as otherwise described herein, the first and second flanges each include a folded hem, and the upper arm of each of the first and second clips includes a protrusion configured to engage the respective folded hem such that the clip latches onto the respective flange. For example, in some embodiments, the upper arm of the clip includes a downward protrusion. As the clip is installed on the respective flange, the protrusion presses against the folded hem section until the protrusion has passed the hem. Once past the hem, the protrusion latches over the hem and prevents accidental withdrawal of the clip from the flange.

Figure 23:
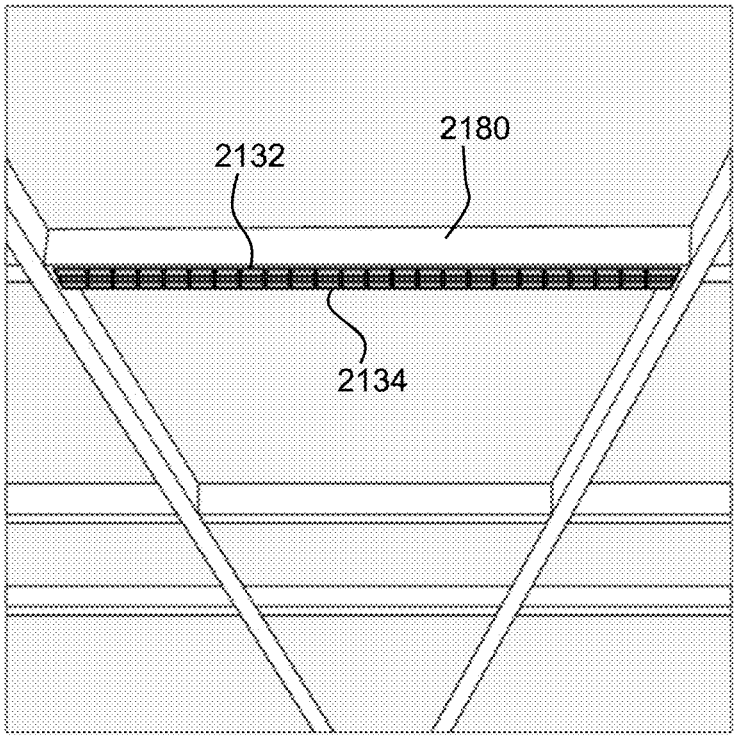
FIG. 23 is a schematic depiction of two ceiling clips installed on a support beam of a ceiling grid.

In certain embodiments as otherwise described herein, the ceiling system includes a plurality of support beams that form a ceiling grid. A portion of such a ceiling grid is shown in FIG. 23. The ceiling grid includes a plurality of support beams 1280 running perpendicular to one another. A first portion of the support beams run along the length of the ceiling and a second portion run across the width of the ceiling. The grid of support beams provides an array of openings to receive ceiling tiles for forming the surface of the ceiling. Each of support beams of the embodiments described above may be part of such a ceiling grid.

In certain embodiments as otherwise described herein, the lighting fixture is substantially the same width as the first support beam. As a result, the lighting fixture and the ceiling grid support beams can appear the similar from below. The phrase substantially the same width, as used herein, refers to a difference in width of no more than 25%. In certain embodiments as otherwise described herein, a width of the lighting housing is no more than 10% wider than the first support beam. Further, in certain embodiments as otherwise described herein, the width of the lighting housing is in a range from 0% to 20% wider than the first support beam. With the width of the lighting housing slightly larger than the width of the ceiling grid support beams, the lighting fixture can conceal the entire width of the support beam but still appear to be the same size as the support beam. In other embodiments, the lighting assembly is substantially wider than the support beam. For example, in some embodiments, the housing of the lighting assembly extends laterally well beyond the flanges of the support beam.

Figure 25:
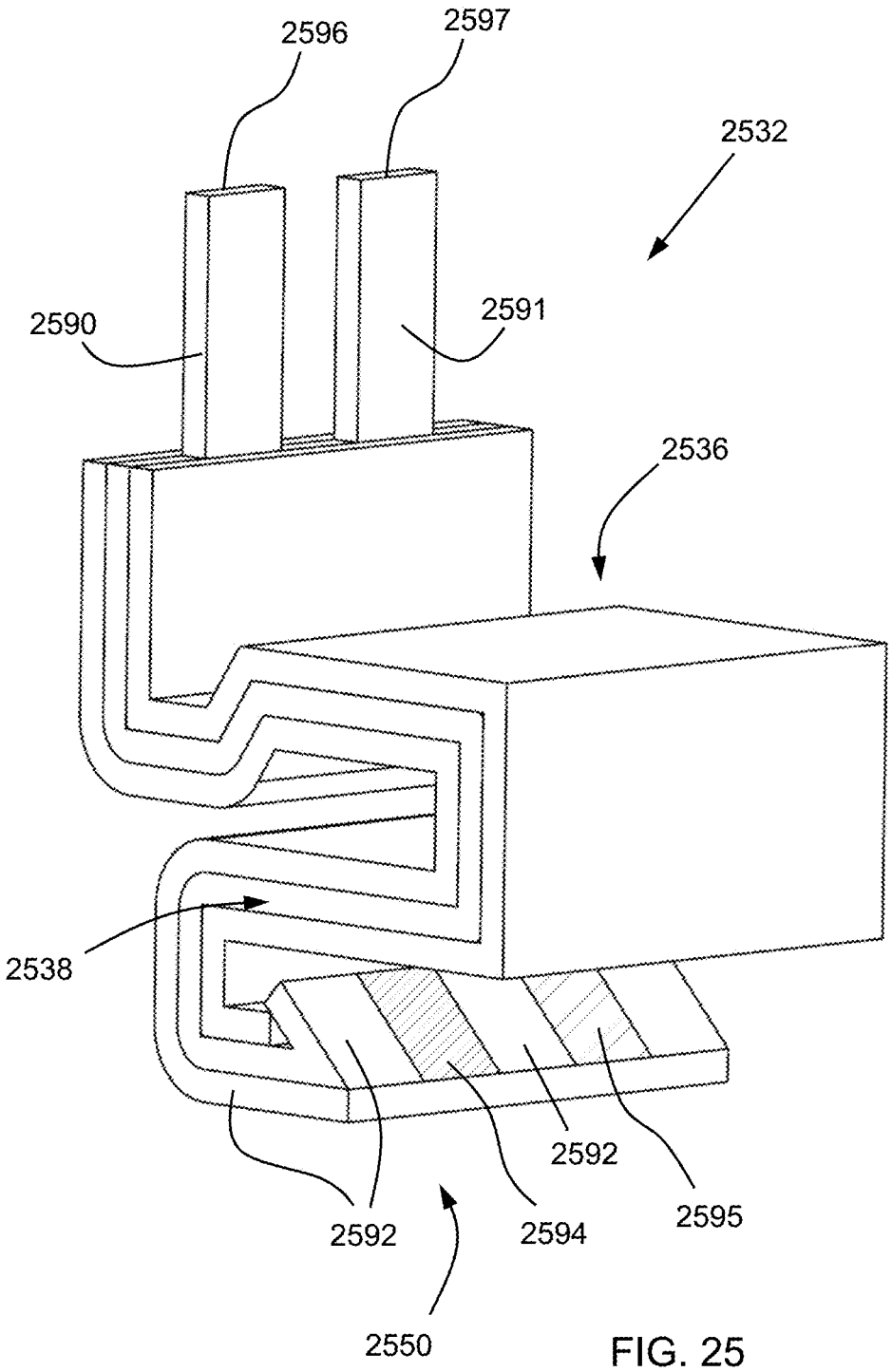
FIG. 25 is a schematic perspective view of an attachment clip according to another embodiment of the disclosure.

In certain embodiments, the clip includes one or more conductive paths extending therethrough. In some embodiments the one or more conductive paths extend from the lower leg to the upper leg of the clip. For example, clip 2532, shown in FIG. 25, includes two conductive paths 2590, 2591 that are each surrounded by an insulating material 2592. Accordingly, the two paths 2590, 2591 are isolated from one another and from any conductive elements in contact with the clip. Each of the paths extends from the upper leg 2536 through the lower leg 2538 to the retainer 2550. Further, the retainer 2550 includes respective electrical contacts 2594, 2595 corresponding to each of the paths 2590, 2591. The two electrical contacts 2594, 2595 are configured to connect to corresponding electrical contacts of the lighting housing. At the top of the clip electrical leads 2596, 2597 are configured to attach to a corresponding element, such as a power source.

In the embodiment of clip 2532, the two conductive paths and contacts are configured to provide power to a lighting housing. In other embodiments, the clip includes a single electrical path. In certain embodiments, the clip includes more than two conductive paths. For example, in some embodiments, an additional path is used for dimming the light source. In other embodiments, an additional conductive path is configured to provide power to another element, such as a sensor. In certain embodiments, the conductive path is configured to transmit data. For example, in some embodiments the conductive path transmits data from a sensor in the lighting housing to a computing device disposed above the ceiling. As will be appreciated by those of ordinary skill in the art, the clip can include any number of conductive paths from the upper side of the clip to the lower side of the clip in order to provide any combination of power or data communication between the lighting housing and electrical components above the ceiling.

Figure 19:
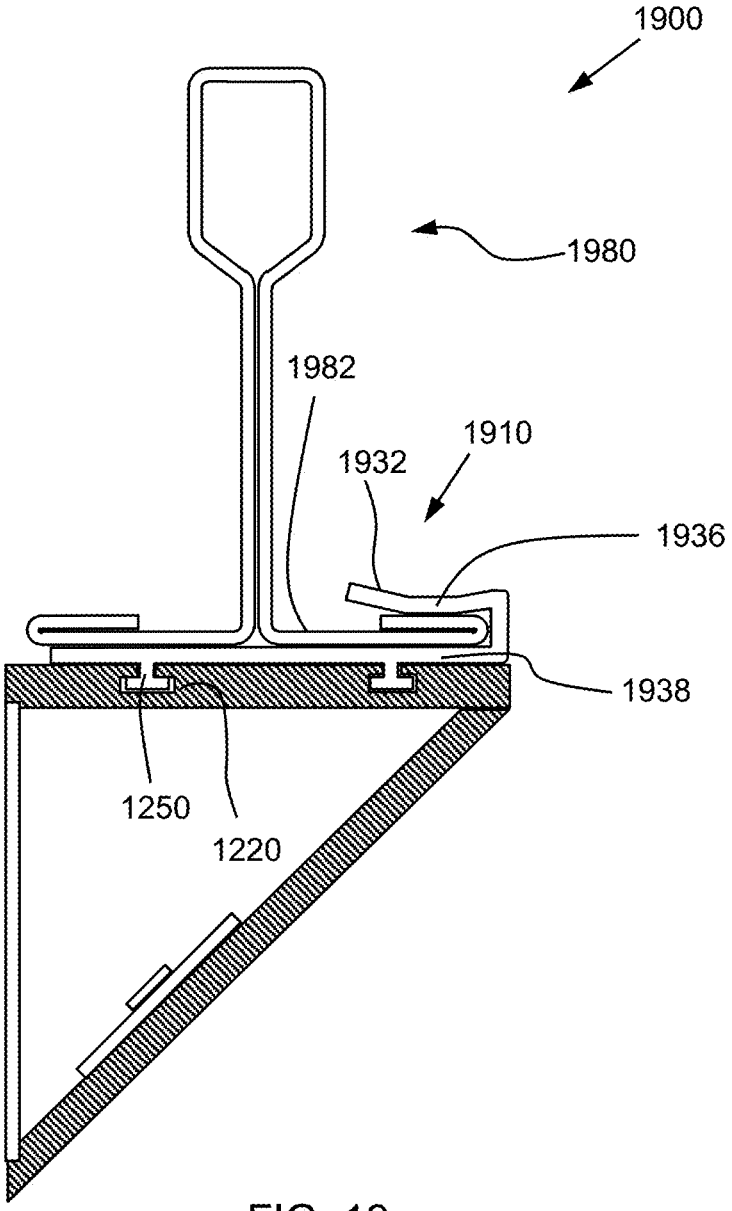
FIG. 19 is a schematic cross-sectional side view of a lighting assembly according to another embodiment of the disclosure.

In another aspect, the disclosure provides a lighting system including a ceiling structure having a support beam including a vertical web, and opposing first and second flanges extending laterally outward from a lower end of the vertical web, each of the first and second flanges including an upper surface and a lower surface. The system also includes a lighting assembly including a housing having an upper surface and forming a cavity below the upper surface, a light source disposed in the cavity of the housing, and a clip. The clip includes an upper arm engaging an upper surface of the first flange, a lower arm connected to the upper arm by a joint and engaging a lower surface of the first flange such that the clip is attached to the first flange, and a retainer disposed on the lower arm. The retainer engages the upper surface of the housing such that the housing is held up by the retainer. Such a system is shown in FIG. 19. System 1900 includes a lighting assembly 1910 attached to a single flange, i.e., first flange 1982 of a ceiling support beam 1980. Lighting assembly 1910 includes a lighting housing 1912 including two slots 1920 in an upper surface thereof. A single clip 1932 attaches the lighting housing 1912 to the ceiling support beam 1980. Clip 1932 includes an upper arm 1936 that engages an upper surface of first flange 1982 and a lower arm 1938 that engages a lower surface of first flange 1982. Accordingly, clip 1932 attaches to first flange 1982 of the ceiling beam. Further, clip 1932 includes two retainers 1950 on a lower side thereof that engage the upper surface of housing 1912 to support light housing 1912. While, assembly 1910 includes two retainers and corresponding slots, other embodiments include a single retainer to support the housing. In various embodiments, the clip includes any of the features of the first and second clips set forth above. Likewise, the lighting housing and light source may include any of the features set forth above.

In another aspect, the disclosure provides a method of installing the lighting system of the disclosure. The method includes providing a ceiling structure including a support beam comprising a vertical web and opposing first and second flanges extending laterally outward from a lower end of the vertical web. A first clip is secured to the first flange by positioning the first flange between an upper arm and a lower arm of the first clip, where the first clip includes a first retainer disposed on the lower arm. A second clip is secured to the second flange by positioning the second flange between an upper arm and a lower arm of the second clip, where the second clip includes a second retainer disposed on the lower arm. The method also includes attaching a housing to the first and second clips using the first and second retainers.

In certain embodiments as otherwise described herein, the housing includes two recesses that cooperate with the retainers of the first and second clips, and wherein the method includes sliding the recesses of the housing over the respective retainers of the clips. For example, housing 1212 of light assembly 1210 includes a slot 1220 including first and second recesses 1222, 1224. Further, the retainers 1250 of first and second clips 1232, 1234 are formed as projections that cooperatively form a dovetail. To attach the housing to the first and second clips 1232, 1234, the slot 1220 is slid over the retainers of the two clips such that each of the projections 1250 of the retainers are respectively positioned in the recesses 1222, 1224 of the housing.

In certain embodiments as otherwise described herein, each of the first and second clips include a plurality of clip sections, and wherein the method includes removing a first group of clip sections from a stock of clip sections so as to form the first clip, and removing a second group of clip sections from the stock of clip sections so as to form the second clip. In some embodiments, the clip sections are connected by a bridge of material, and removing the first and second groups of clip sections includes breaking the bridge of material between adjacent clip sections.

In certain embodiments as otherwise described herein, the method further includes separating the first clip into two portions, each portion including a number of clip sections, and separating the two portions of the first clip along the first flange. In some embodiments, the second clip is also separated into two portions. The separate portions of the clip can be separated along the respective to provide a gap to accommodate structure that might otherwise interfere with the clips. For example, in some embodiments, the portions of the clip are separated to provide space for an electrical connection, such as a wire, to the light housing. In other embodiments, the portions of the clip are separate to avoid a junction with a cross beam. In certain embodiments, the method includes removing only the upper arm and/or lower arm of a clip section, but retaining the joint portion of the altered clip section, which forms the bridge between adjacent sections. The retained bridge provides a visually continuous clip, despite the removal of the upper and/or lower arm, which may be used as a path for an electrical wire or otherwise.

Figure 21:
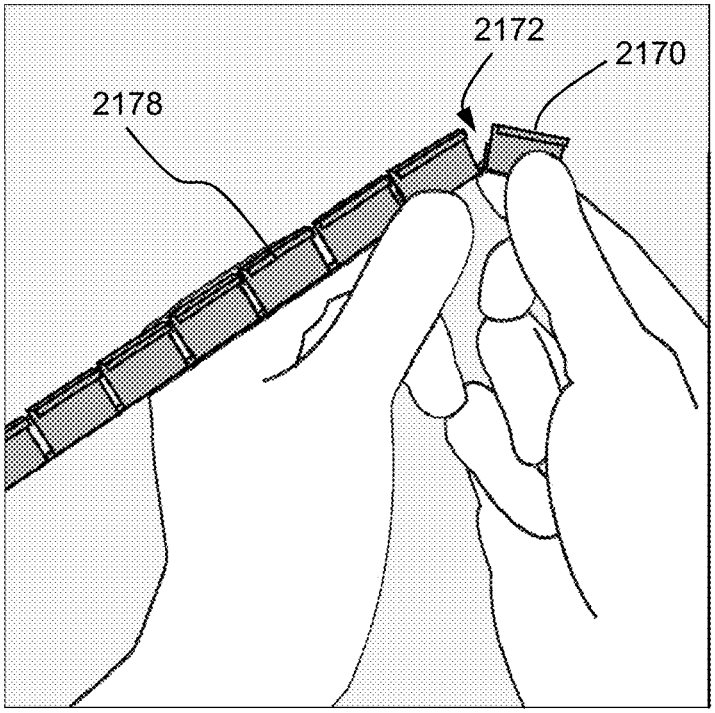
FIG. 21 is a schematic depiction of a person preparing a ceiling clip for installation on a support beam.

An embodiment of a method of installing a lighting system is described in the following with reference to FIGS. 21-24. First and second clips are prepared for installation by removing a group of clip sections from a stock of clip sections. To remove the clip from the stock of sections, a group of the clip sections are broken off of the stock. Breaking the bridge between adjacent clip sections can be achieved, for example, by bending the bridge and then pulling the clip sections apart. As an example, FIG. 21 shows a single clip section 2170 being bent along bridge 2172 from a stock 2178 of clip sections, in preparation for breaking the bridge 2172. The length of each clip is determined by choosing the number of clip sections and breaking the appropriate number of sections from the stock of clip sections.

Figure 22:
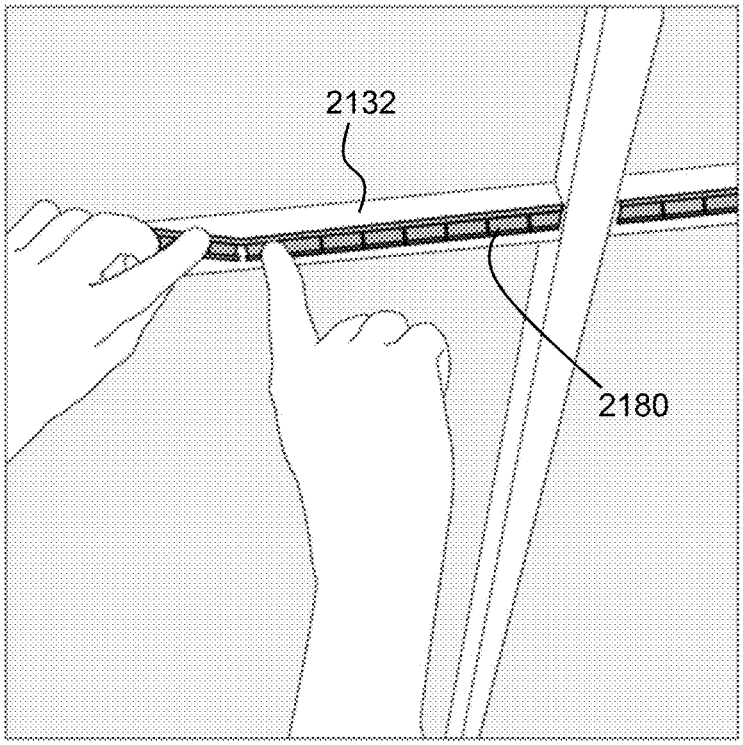
FIG. 22 is a schematic depiction of a person installing a ceiling clip on a support beam.
Figure 24:
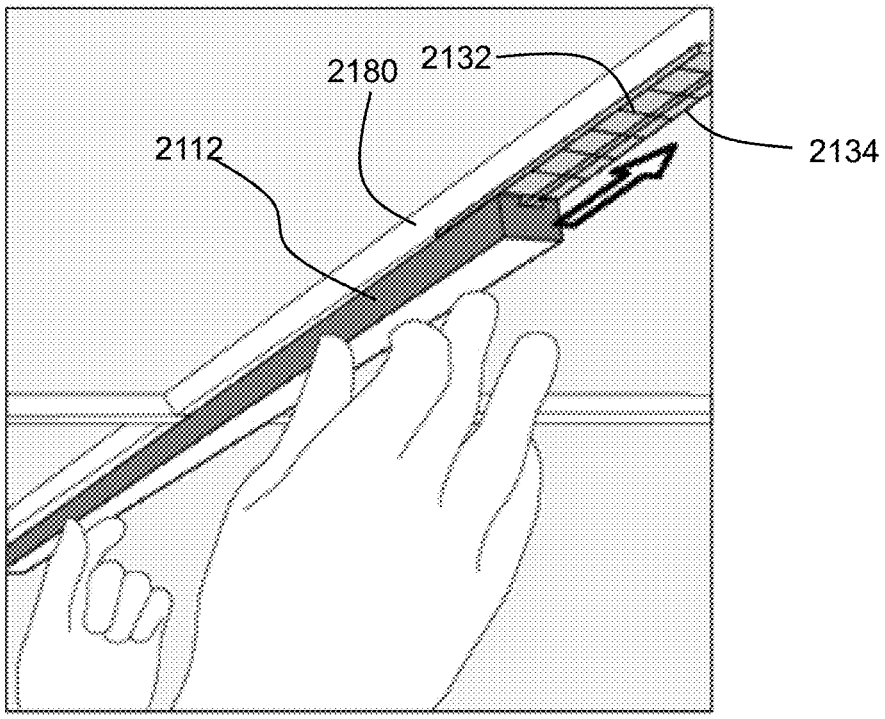
FIG. 24 is a schematic depiction of a person installing a light housing onto two ceiling clips according to an embodiment of the disclosure.

The first and second clip sections are attached to the support beam by pushing the clips onto the flanges of the beam so that the arms of the clips are engaged with the upper and lower surfaces of the flanges, as described in more detail above. For example, FIG. 22 illustrates a first clip 2132 being attached to a corresponding support beam 2180, and FIG. 23 shows first and second clips 2132, 2134 both installed on the support beam 2180. As shown in FIG. 24, a light housing 2112 is then attached to the clips 2132, 2134 by sliding the recesses of the corresponding retainers. It should be understood that the foregoing description of an embodiment of the method is only exemplary, and that the steps are not limited by any particular order.

The details of the lighting fixtures and systems as described herein with respect to FIGS. 12-25 can be used in conjunction with the lighting fixtures and systems described above with respect to FIGS. 1-11. The person of ordinary skill in the art can combine any embodiment of this disclosure described with respect to FIGS. 1-11 with any suitable embodiment as described with respect to FIGS. 12-25.

Additional embodiments of the disclosure are provided by the following enumerated embodiments, which can be combined in any number and in any combination that is not technically or logically inconsistent.

Embodiment 1. A lighting fixture comprising:

an elongate housing extending in a first direction from a first end to a second end, the housing including:

a base configured to attach to a building surface and define a mounting surface of the housing, and a cover extending over the base so as to form a cavity in the housing and define a closed side of the housing and an open side of the housing, wherein the lighting fixture extends no more than 3 inches from the building surface; and a light source disposed in the housing, wherein the lighting fixture is configured to emit light through the open side of the housing so as to direct the light in an upward direction.

Embodiment 2. The lighting fixture according to embodiment 1, wherein the cover includes an elongate wall extending from the base at the closed side of the housing to the open side of the housing, at least a portion of the elongate wall being disposed at an angle to the base so as to form the cavity of the housing between the base and the angled wall.

Embodiment 3. The lighting fixture according to embodiment 2, wherein the elongate wall is adjacent and parallel to the base at the first end and at the second end, such that the housing is closed at the first end and the second end.

Embodiment 4. The lighting fixture according to embodiment 2 or embodiment 3, wherein the open side of the housing includes an opening having a straight edge defined by the base and a curved or angular edge defined by the cover.

Embodiment 5. The lighting fixture according to any of embodiments 2 to 4, wherein the elongate wall has the form of a ruled surface, and wherein the angle between the cover and the base changes along at least a portion of the length of the housing.

Embodiment 6. The lighting fixture according to any of embodiments 2 to 5, wherein an edge surrounding the opening is planar.

Embodiment 7. The lighting fixture according to any of embodiments 1 to 6, wherein a width of the lighting fixture is no more than 6 inches, e.g., no more than 2 inches.

Embodiment 8. The lighting fixture according to any of embodiments 1 to 7, wherein a width of the lighting fixture is in a range from ½ inch to 1-½ inches, e.g. between ¾ inch and 1-¼ inch.

Embodiment 9. The lighting fixture according to any of embodiments 1 to 8, wherein a length of the lighting fixture is in a range from 18 to 55 inches, e.g., about 24 inches or e.g., about 48 inches.

Embodiment 10. The lighting fixture according to any of embodiments 1 to 9, wherein a height of the lighting fixture is less than 3 inches, e.g., less than 2 inches.

Embodiment 11. The lighting fixture according to any of embodiments 1 to 10, wherein the housing is plastic.

Embodiment 12. The lighting fixture according to any of embodiments 1 to 11, wherein the base of the housing includes a fastener configured to removably secure the lighting fixture to a ceiling.

Embodiment 13. The lighting fixture according to embodiment 12, wherein the fastener is a dovetail recess.

Embodiment 14. The lighting fixture according to any of embodiments 1 to 13, wherein the housing includes stiffening ribs extending between the base and the cover.

Embodiment 15. The lighting fixture according to any of embodiments 1 to 14, wherein the light source includes an LED element comprising a plurality of LEDs.

Embodiment 16. The lighting fixture according to embodiment 15, wherein the cover includes an elongate wall, and wherein the LED element is adjacent to the elongate wall and is positioned to emit light away from the cover.

Embodiment 17. The lighting fixture according to embodiment 16, wherein at least a portion of the LED element is parallel to the elongate wall at a respective lateral cross section of the lighting fixture.

Embodiment 18. The lighting fixture according to embodiment 15, wherein the LED element is adjacent to the base and is positioned to emit light away from the base.

Embodiment 19. The lighting fixture according to embodiment 18, wherein the housing includes a reflector.

Embodiment 20. The lighting fixture according to embodiment 19, wherein the cover forms the reflector.

Embodiment 21. The lighting fixture according to any of embodiments 15 to 20, further comprising a light shield disposed in the housing at the lower side of the housing adjacent to the open side of the housing so as to prevent glare to observers below the lighting fixture.

Embodiment 22. The lighting fixture according to any of embodiments 15 to 21, further comprising a thermal conductor extending from the LED element to the mounting surface of the base.

Embodiment 23. The lighting fixture according to embodiment 22, wherein the thermal conductor includes a heat pipe including a chamber containing a heat transfer fluid.

Embodiment 24. The lighting fixture according to any of embodiments 15 to 21, further comprising a heat sink in thermal communication with the LED element.

Embodiment 25. The lighting fixture according to embodiment 24, wherein the heat sink is adjacent to a section of the cover, and wherein the section of the cover includes vents between the cavity and the external surface of the housing.

Embodiment 26. The lighting fixture according to any of embodiments 15 to 25, further comprising a plurality of support clips, each of the support clips including a support leg disposed in the cavity of the housing and extending from a base leg adjacent to the base of the housing, and wherein the LED element is attached to the support legs of the support clips.

Embodiment 27. The lighting fixture according to embodiment 26, wherein at a first lateral cross section of the lighting fixture the support leg is parallel to the cover and at a second lateral cross section of the lighting fixture the support leg is at an angle to the cover.

Embodiment 28. The lighting fixture according to embodiment 26 or embodiment 27, wherein the support leg of some of the support clips include an offset portion extending toward the open side of the housing and an angled portion supporting the LED element.

Embodiment 29. The lighting fixture according to embodiment 28, wherein the respective offset portions of at least two of the support legs have different lengths.

Embodiment 30. The lighting fixture according to any of embodiments 26 to 29, wherein each of the support clips is positioned directly under a respective LED of the LED element.

Embodiment 31. The lighting fixture according to any of embodiments 26 to 30, wherein the support clips extend through the base of the housing so as to form a thermal conductor in thermal communication with the mounting surface of the housing.

Embodiment 32. The lighting fixture according to any of embodiments 1 to 31, further comprising a window enclosing the open side of the housing.

Embodiment 33. The lighting fixture according to embodiment 32, wherein the window includes a lens.

Embodiment 34. The lighting fixture according to embodiment 32 or embodiment 33, wherein the window includes a diffuser.

Embodiment 35. The lighting fixture according to any of embodiments 32 to 34, further comprising light piping extending between the light source and the window so as to provide light in corner regions of the window.

Embodiment 36. A suspension ceiling lighting system comprising:

- a suspension ceiling including a plurality of support beams arranged in rows and columns to form a ceiling grid;
- a lighting fixture according to any of embodiments 1 to 35 attached to the ceiling grid.

Embodiment 37. The suspension ceiling lighting system according to embodiment 36, wherein the lighting fixture is attached to a first support beam of the ceiling grid and extends in a direction that is parallel to the first support beam.

Embodiment 38. The suspension ceiling lighting system according to embodiment 36 or embodiment 37, wherein the lighting fixture is substantially the same width as the first support beam.

Embodiment 39. The suspension ceiling lighting system according to any of embodiments 36 to 38, wherein a width of the lighting fixture is no more than 10% wider than the first support beam.

Embodiment 40. The suspension ceiling lighting system according to embodiment 39, wherein the width of the lighting fixture is in a range from 0% to 10% wider than the first support beam.

Embodiment 41. The suspension ceiling lighting system according to any of embodiments 36 to 40, wherein the system includes a plurality of lighting fixtures according to any of embodiments 1 to 35 attached to the ceiling grid.

Embodiment 42. The suspension ceiling lighting system according to embodiment 41, wherein a group of the plurality of lighting fixtures is arranged in a line along one column of the ceiling grid.

Embodiment 43. The suspension ceiling lighting system according to embodiment 41, wherein a group of four of the plurality of lighting fixtures is arranged in a rectangle, with the open side of each of the group of four lighting fixtures arranged on the outside of the rectangle.

Embodiment 44. The suspension ceiling lighting system according to embodiment 41, wherein a group of four of the plurality of lighting fixtures is arranged in a rectangle, with the open side of each of the group of four lighting fixtures arranged on the inside of the rectangle.

Embodiment 45. A lighting assembly comprising:

- a housing including a base and a cavity below the base;
- a light source disposed in the cavity of the housing; and
- first and second clips configured to respectively attach to first and second flanges of a ceiling support beam, each of the first and second clips including:
  - an upper arm configured to engage an upper surface of the respective flange,
  - a lower arm connected to the upper arm by a joint and configured to extend below the respective flange under the upper arm, and
  - a retainer disposed on the lower arm and configured to engage the base of the housing such that the housing is held up by the respective retainers of the first and second clips and lateral movement of the first and second clips is inhibited.

Embodiment 46. The lighting assembly according to embodiment 45, wherein the retainer of each clip includes a projection that engages an upper surface of the housing.

Embodiment 47. The lighting assembly according to embodiment 46, wherein each of the projections is formed as a hook.

Embodiment 48. The lighting assembly according to embodiment 46 or embodiment 47, wherein the housing includes:

- a first recess that cooperates with the projection of the first clip to form a linked connection between the first clip and the housing, and
- a second recess that cooperates with the projection of the second clip to form a linked connection between the second clip and the housing.

Embodiment 49. The lighting assembly according to embodiment 48, wherein each of the recesses includes an inward facing wall that abuts the projection of the respective clip to prevent outward lateral movement of the respective clip.

Embodiment 50. The lighting assembly according to embodiment 48 or embodiment 49, wherein the projection of each of the clips is disposed at an inner end of the respective lower leg.

Embodiment 51. The lighting assembly according to embodiment 50, wherein the projection of the first clip is adjacent to the projection of the second clip.

Embodiment 52. The lighting assembly according to embodiment 50 or embodiment 51, wherein the first recess and second recess are disposed on lateral sides of a slot that extends along the length of the housing, and wherein the projections of both the first and second clips are disposed in the slot.

Embodiment 53. The lighting assembly according to embodiment 48 or embodiment 49, wherein a portion of the housing separates the first recess and the second recess.

Embodiment 54. The lighting assembly according to any of embodiments 45 to 53, wherein the first clip and the second clip are symmetrical.

Embodiment 55. The lighting assembly according to any of embodiments 45 to 53, wherein the first clip and the second clip are asymmetrical.

Embodiment 56. The lighting assembly according to 45, wherein the retainer of each clip includes a recess.

Embodiment 57. The lighting assembly according to embodiment 56, wherein the housing includes:

- a first projection that cooperates with the recess of the first clip to form a linked connection between the first clip and the housing, and a second projection that cooperates with the recess of the second clip to form a linked connection between the second clip and the housing.

Embodiment 58. The lighting assembly according to embodiment 45, wherein the lower arm of each clip engages a slot in the base of the housing.

Embodiment 59. The lighting assembly according to embodiment 58, wherein the lower arm of each clip includes a tooth and the slot includes a catch configured to engage the tooth and retain the lower arm in the slot.

Embodiment 60. The lighting assembly according to any of embodiments 45 to 59, wherein the upper arm and lower arm of each clip are spaced apart by the joint.

Embodiment 61. The lighting assembly according to any of embodiments 45 to 60, wherein an inner end of the upper arm of each clip flares away from the lower arm.

Embodiment 62. The lighting assembly according to any of embodiments 45 to 61, wherein each clip is formed of metal.

Embodiment 63. The lighting assembly according to any of embodiments 45 to 62, wherein the housing is formed of plastic.

Embodiment 64. The lighting assembly according to any of embodiments 45 to 63, wherein a length of the housing is in a range from 18 to 55 inches, e.g., about 24 inches or e.g., about 48 inches.

Embodiment 65. The lighting assembly according to any of embodiments 45 to 64, wherein the light source includes an LED element comprising a plurality of LEDs.

Embodiment 66. The lighting assembly according to embodiment 65, further comprising a support clip disposed in the cavity of the housing, wherein the LED element is attached to the support clip.

Embodiment 67. The lighting assembly according to embodiment 66, wherein the support clip abuts the first clip so as to provide thermal communication between the LED element and the first clip.

Embodiment 68. The lighting assembly according to any of embodiments 45 to 67, wherein each clip includes a row of clip sections along the length of the housing.

Embodiment 69. The lighting assembly according to embodiment 68, wherein the clip sections are attached by a bridge.

Embodiment 70. A lighting system comprising:

a ceiling structure including a support beam comprising:

a vertical web, and opposing first and second flanges extending laterally outward from a lower end of the vertical web, each of the first and second flanges including an upper surface and a lower surface; and the lighting assembly according to any of embodiments 45-69 attached to the support beam, wherein the first and second clips of the lighting assembly are respectively attached to the first and second flanges of the support beam, with the upper arm of each clip engaging the upper surface of the respective flange and the lower arm of each clip engaging the lower surface of the respective flange so as to retain the lighting assembly on the support beam.

Embodiment 71. The lighting system according to embodiment 70, wherein the upper and lower arms of each of the clips apply a clamping force against the upper and lower surfaces of the respective flange of the support beam.

Embodiment 72. The lighting system according to embodiment 71, wherein the first and second flanges each include a folded hem, and wherein the upper arm of each of the first and second clips applies the clamping force against the respective folded hem.

Embodiment 73. The lighting system according to embodiment 70 or embodiment 72, wherein the first and second flanges each include a folded hem, and wherein the upper arm of each of the first and second clips includes a protrusion configured to engage the respective folded hem such that the clip latches onto the respective flange.

Embodiment 74. The lighting system according to any of embodiments 70 to 73, wherein the ceiling system includes a plurality of support beams that form a ceiling grid.

Embodiment 75. The lighting system according to any of embodiments 70 to 74, wherein the lighting assembly is substantially the same width as the support beam.

Embodiment lighting system is no more than 25% wider than the support beam.

Embodiment 77. The suspension ceiling lighting system according to any of embodiments 70 to 76, wherein a width of the lighting housing is in a range from 0% to 10% wider than the first support beam.

Embodiment 78. A method of installing the lighting system of any of embodiments 70 to 77, the method comprising:

providing a ceiling structure including a support beam comprising a vertical web and opposing first and second flanges extending laterally outward from a lower end of the vertical web;

securing a first clip to the first flange by positioning the first flange between an upper arm and a lower arm of the first clip, wherein the first clip includes a first retainer disposed on the lower arm;

securing a second clip to the second flange by positioning the second flange between an upper arm and a lower arm of the second clip, wherein the second clip includes a second retainer disposed on the lower arm; and attaching a housing to the first and second clips using the first and second retainers.

Embodiment 79. The method according to embodiment 78, wherein the housing includes two recesses that cooperate with the retainers of the first and second clips, and wherein the method includes sliding the recesses of the housing over the respective retainers of the clips.

Embodiment 80. The method according to embodiment 78 or embodiment 79, wherein each of the first and second clips include a plurality of clip sections, and wherein the method includes removing a first group of clip sections from a stock of clip sections so as to form the first clip, and removing a second group of clip sections from the stock of clip sections so as to form the second clip.

Embodiment 81. The method according to embodiment 80, wherein the clip sections are connected by a bridge of material, and wherein removing the first and second groups of clip sections includes breaking the bridge of material between adjacent clip sections.

Embodiment 82. The method according to embodiment 80 or 81, further comprising separating the first clip into two portions, each portion including a number of clip sections, and separating the two portions of the first clip along the first flange.

Embodiment 83. A lighting system comprising:

a ceiling structure including a support beam comprising:

a vertical web, and opposing first and second flanges extending laterally outward from a lower end of the vertical web, each of the first and second flanges including an upper surface and a lower surface; and a lighting assembly comprising:

a housing including an upper surface and forming a cavity below the upper surface;

a light source disposed in the cavity of the housing; and a clip including:

an upper arm engaging an upper surface of the first flange, a lower arm connected to the upper arm by a joint and engaging a lower surface of the first flange such that the clip is attached to the first flange, and a retainer disposed on the lower arm, the retainer engaging the upper surface of the housing such that the housing is held up by the retainer.

Embodiment 84. The lighting system according to embodiment 83, further comprising the features of any of embodiments 46, 56, and 58-69.

Embodiment 85. The lighting system according to any of embodiments 45-84, wherein the housing and the light source are configured as in any of embodiments 1-44.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A lighting fixture comprising:

an elongate housing extending in a first direction from a first end to a second end, the housing including:

a base configured to attach to a building surface and define a mounting surface along an upper side of the housing, and a cover extending over the base so as to form a cavity in the housing and define a closed side of the housing and an open side of the housing, wherein the lighting fixture extends no more than 3 inches from the mounting surface; and a light source disposed in the housing, wherein the lighting fixture is configured to emit light through the open side of the housing so as to direct the light in an upward direction.

2. The lighting fixture according to claim 1, wherein the cover includes an elongate wall extending from the base at the closed side of the housing to the open side of the housing, at least a portion of the elongate wall being disposed at an angle to the base so as to form the cavity of the housing between the base and the angled wall.

3. The lighting fixture according to claim 2, wherein the elongate wall has the form of a ruled surface, and wherein the angle between the cover and the base changes along at least a portion of the length of the housing.

4. The lighting fixture according to claim 1, wherein the cover includes an elongate wall, and the light source includes an LED element comprising a plurality of LEDs, the LED element being adjacent to the elongate wall and positioned to emit light away from the cover.

5. The lighting fixture according to claim 4, further comprising a plurality of support clips, each of the support clips including a support leg disposed in the cavity of the housing and extending from a base leg adjacent to the base of the housing, and wherein the LED element is attached to the support legs of the support clips.

6. The lighting fixture according to claim 5, wherein the support clips extend through the base of the housing so as to form a thermal conductor in thermal communication with the mounting surface of the housing.

7. The lighting fixture according to claim 4, wherein the LED element is adjacent to the base and is positioned to emit light away from the base, and wherein the housing includes a reflector.

8. The lighting fixture according to claim 4, further comprising a light shield disposed in the housing at the lower side of the housing adjacent to the open side of the housing so as to prevent glare to observers below the lighting fixture.

9. The lighting fixture according to claim 4, further comprising a heat sink in thermal communication with the LED element.

10. The lighting fixture according to claim 9, wherein the heat sink is adjacent to a section of the cover, and wherein the section of the cover includes vents between the cavity and the external surface of the housing.

11. A suspension ceiling lighting system comprising:

a suspension ceiling including a plurality of support beams arranged in rows and columns to form a ceiling grid;

one or more lighting fixtures according to claim 1 attached to the ceiling grid.

12. The suspension ceiling lighting system according to claim 11, wherein a plurality of lighting fixtures is arranged in a line along one column of the ceiling grid.

13. The lighting fixture according to claim 1, further comprising a window enclosing the open side of the housing.

14. The lighting fixture according to claim 13, wherein the window includes a diffuser.

15. A lighting assembly comprising:

a lighting fixture according to claim 1; and first and second clips configured to respectively attach to first and second flanges of a ceiling support beam, each of the first and second clips including:

an upper arm configured to engage an upper surface of the respective flange, a lower arm connected to the upper arm by a joint and configured to extend below the respective flange under the upper arm, and a retainer disposed on the lower arm and configured to engage the base of the housing of the lighting fixture such that the housing is held up by the respective retainers of the first and second clips and lateral movement of the first and second clips is inhibited.

16. A lighting system comprising:

a ceiling structure including a support beam comprising:

a vertical web, and opposing first and second flanges extending laterally outward from a lower end of the vertical web, each of the first and second flanges including an upper surface and a lower surface; and the lighting assembly according to claim 15 attached to the support beam, wherein the first and second clips of the lighting assembly are respectively attached to the first and second flanges of the support beam, with the upper arm of each clip engaging the upper surface of the respective flange and the lower arm of each clip engaging the lower surface of the respective flange so as to retain the lighting assembly on the support beam.

17. A lighting fixture comprising:

an elongate housing extending in a first direction from a first end to a second end, the housing including:

a base configured to attach to a building surface and define a mounting surface of the housing, and a cover extending over the base so as to form a cavity in the housing and define a closed side of the housing and an open side of the housing; and a light source disposed in the housing, wherein the lighting fixture is configured to emit light through the open side of the housing so as to direct the light in an upward direction, wherein the cover includes an elongate wall extending from the base at the closed side of the housing to the open side of the housing, at least a portion of the elongate wall being disposed at an angle to the base so as to form the cavity of the housing between the base and the angled wall, and wherein the elongate wall is adjacent and parallel to the base at the first end and at the second end, such that the housing is closed at the first end and the second end.

18. A lighting fixture comprising:

an elongate housing extending in a first direction from a first end to a second end, the housing including:

a base configured to attach to a building surface and define a mounting surface of the housing, and a cover extending over the base so as to form a cavity in the housing and define a closed side of the housing and an open side of the housing; and a light source disposed in the housing, wherein the lighting fixture is configured to emit light through the open side of the housing so as to direct the light in an upward direction, wherein the cover includes an elongate wall extending from the base at the closed side of the housing to the open side of the housing, at least a portion of the elongate wall being disposed at an angle to the base so as to form the cavity of the housing between the base and the angled wall, and wherein the open side of the housing includes an opening having a straight edge defined by the base and a curved or angular edge defined by the cover.

* * * * *